US008094099B2

(12) United States Patent
Uchino et al.

(10) Patent No.: US 8,094,099 B2
(45) Date of Patent: Jan. 10, 2012

(54) DISPLAY APPARATUS AND DRIVING METHOD FOR DISPLAY APPARATUS

(75) Inventors: Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 814 days.

(21) Appl. No.: 12/222,851

(22) Filed: Aug. 18, 2008

(65) Prior Publication Data

US 2009/0066616 A1 Mar. 12, 2009

(30) Foreign Application Priority Data

Sep. 12, 2007 (JP) ..... 2007-236110

(51) Int. Cl.
*G09G 3/30* (2006.01)

(52) U.S. Cl. ..... 345/77; 345/76; 345/79; 345/690

(58) Field of Classification Search ..... 345/76, 345/77, 87–89, 690
See application file for complete search history.

(56) References Cited

U.S. PATENT DOCUMENTS 5,684,365 A 11/1997 Tang et al.

FOREIGN PATENT DOCUMENTS

JP 08-234683 A 9/1996

*Primary Examiner* — Amare Mengistu
*Assistant Examiner* — Koosha Sharifi-Tafreshi
(74) *Attorney, Agent, or Firm* — Rader, Fishman & Grauer PLLC

(57) ABSTRACT

The present invention provides a display apparatus, including: a display section including a plurality of pixels disposed in a matrix and a plurality of signal lines and a plurality of scanning lines; and a horizontal driving circuit and a vertical driving circuit configured to drive the signal lines and the scanning lines of the display section to display an image on the display section; each of the pixels including a light emitting device; a signal level storage capacitor, a writing transistor, and a driving transistor.

5 Claims, 19 Drawing Sheets

TA
Vofs2
Vofs
VsigR
VsigG
VsigB
Ssig
SIGR
SIGG
SIGB
Ws
VgG
VgR
VgB
VsG
VsR
VsB
Vofs-Vth
1H(Tμ)

1H
P2R - P2B

P1R - P1B

TR

TG

TB

SIGR
VsigR

Vofs2
Vofs
SIGG
VsigG

Vofs2
Vofs
SIGB
VsigB

Vofs2
Vofs

FIG.24
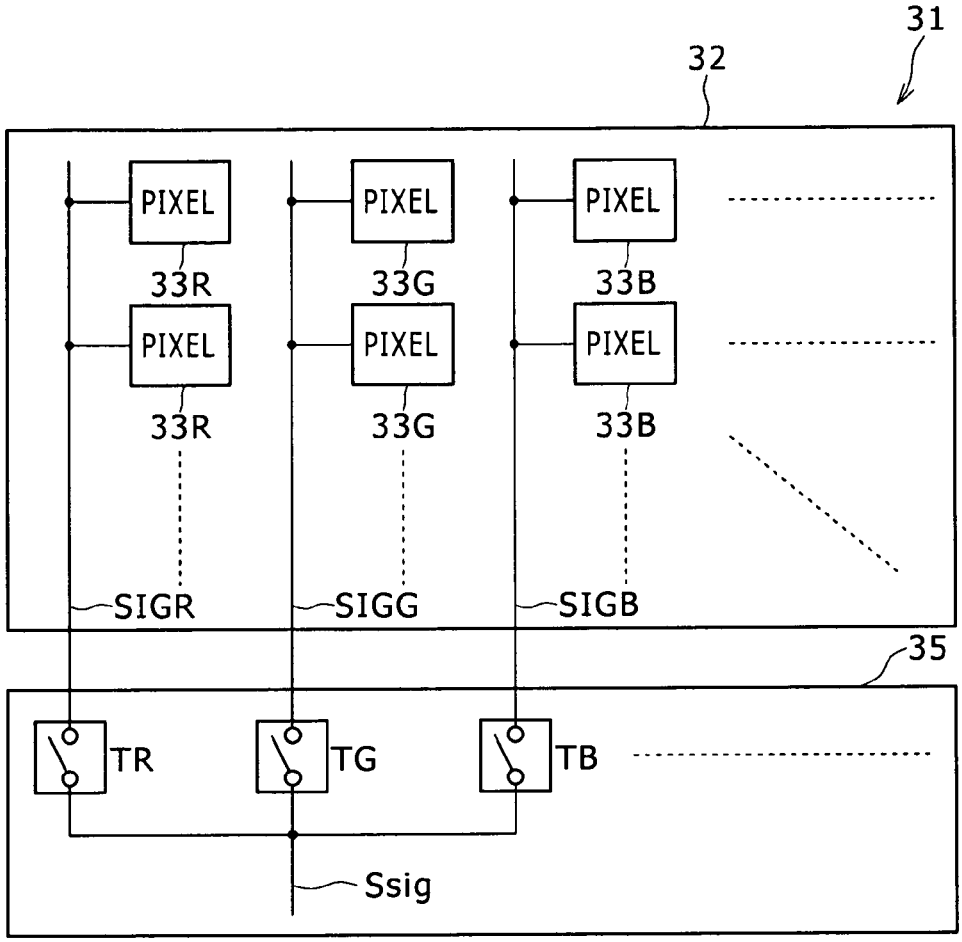
FIG.25A
FIG.25B
FIG.25C
FIG.25D
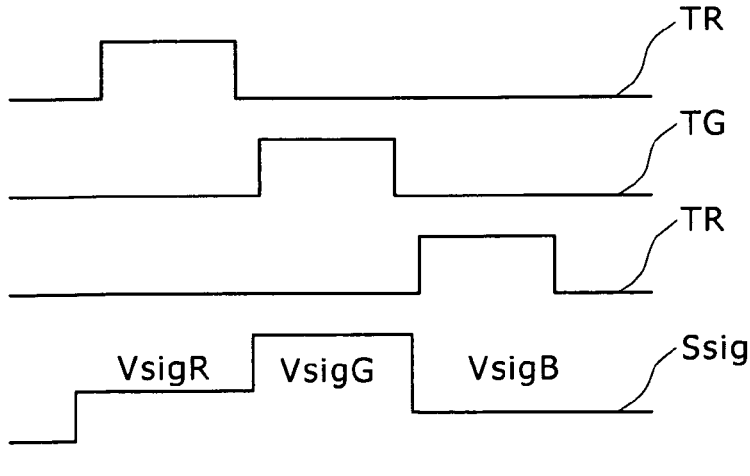

1H

Vofs
Vofs2
VsigR
VsigG
VsigB
Ssig

Vofs
Vofs2
VsigR
SIGR

Vofs
Vofs2
VsigG
SIGG

Vofs
Vofs2
VsigB
SIGB

Ws
Th3
Tμ1
Tμ2
Vg
Vs
ΔV
Vofs2

Vofs

Vofs-Vth

DISPLAY APPARATUS AND DRIVING METHOD FOR DISPLAY APPARATUS

CROSS REFERENCES TO RELATED APPLICATIONS

The present invention contains subject matter related to Japanese Patent Application JP 2007-236110, filed in the Japan Patent Office on Sep. 12, 2007, the entire contents of which being incorporated herein by reference.

BACKGROUND OF THE INVENTION

1. Field of the Invention

This invention relates to a display apparatus and a driving method for a display apparatus and can be applied to a display apparatus of the active matrix type for which, for example, an organic EL (Electro Luminescence) device is used.

2. Description of the Related Art

In related art, various inventions have been proposed for a display apparatus which uses an organic EL device and are disclosed, for example, In U.S. Pat. No. 5,684,365 or Japanese Patent Laid-Open No. Hei 8-234683.

FIG. 4 shows an existing display apparatus of the active matrix type which uses an organic EL device. Referring to FIG. 1, the display apparatus 1 includes a display section 2 in which pixels (PX) 3 are disposed in a matrix. The display section 2 further includes scanning lines SCN provided in a horizontal direction for individual rows and signal lines SIG provided for individual columns perpendicularly to the scanning lines SCN.

Referring now to FIG. 5, each pixel 3 includes an organic EL device 8 which is a self-luminous device of the current-driven type, and a driving circuit (hereinafter referred to as pixel circuit) for driving the organic EL device 8.

Referring to FIG. 5, the pixel 3 includes a signal level storage capacitor C1 having a first terminal connected to a fixed potential and a second terminal connected to a signal line SIG through a transistor TR1 which turns on/off in response to a writing signal WS. Consequently, in the pixel 3, the transistor TR1 turns on in response to a rising edge of the writing signal WS, whereupon the potential at the second terminal of the signal level storage capacitor C1 is set to the signal level of the signal line SIG. Then, at a timing at which the transistor TR1 changes over from an on state to an off state, the signal level of the signal line SIG is sample held by the second terminal of the signal level storage capacitor C1.

The pixel 3 further includes a P-channel transistor TR2 connected at the source thereof to a power supply Vcc, at the gate thereof to the second terminal of the signal level storage capacitor C1 and at the drain thereof to the anode of the organic EL device 8. Here, the pixel 3 is set such that the transistor TR2 normally operates in a saturation region. As a result, the transistor TR2 forms a constant current circuit of drain-source current Ids represented by an expression given below:

$$I_{ds} = \frac{1}{2}\mu\frac{W}{L}C_{ox}(V_{gs} - V_{th})^2 \quad (1)$$

Where Vgs is the gate-source voltage of the transistor TR2; μ the mobility; W the channel width; L the channel length; Cox the capacitance of a gate insulating film per unit area; and Vth the threshold voltage of the transistor TR2. Consequently, in each pixel 3, the organic EL device 8 is driven with driving current Ids corresponding to the signal level of the signal line SIG sample held by the signal level storage capacitor C1.

In the display apparatus 1, a write scanning circuit (WSCN) 4A of a vertical driving circuit 4 successively transfers a predetermined sampling pulse to produce a writing signal WS which is a timing signal indicative of writing into each pixel 3. Meanwhile, a horizontal selector (HSEL) 5A of a horizontal driving circuit 5 successively transfers a predetermined sampling pulse to produce a timing signal and sets each signal line SIG to the signal level of an input signal S1 with reference to the timing signal. Consequently, the display apparatus 1 sets the terminal voltage of the signal level storage capacitor C1 provided in the display section 2 dot-sequentially or line-sequentially in response to the input signal S1 to display an image according to the input signal S1.

Here, the organic EL device 8 has a current-voltage characteristic which varies in a direction in which current becomes less liable to flow during use as time passes as seen in FIG. 6. In particular, in FIG. 6, a curve L1 indicates the characteristic at an initial state, and another curve L2 indicates the characteristic after secular change. However, where the organic EL device 8 is driven by the transistor TR2 in the circuit configuration shown in FIG. 5, since the P-channel transistor TR2 drives the organic EL device 8 with the gate-source voltage Vgs set in response to the signal level of the signal line SIG, the secular change of each pixel by the secular change of the current-voltage characteristic can be prevented.

Incidentally, if all of transistors which form the pixel circuits, horizontal driving circuit and vertical driving circuit are formed from N-channel transistors, then the circuits mentioned can be produced collectively on an insulating substrate such a glass substrate by an amorphous silicon process, and a display apparatus can be produced simply and readily.

However, as seen from FIG. 7 in contrast to FIG. 5, where an N-channel transistor is applied to the transistor TR2 to form pixels 13 and a display apparatus 11 is formed from a display section 12 which includes the pixels 13, since the source of the transistor TR2 is connected to the organic EL device 8, the gate-source voltage Vgs of the transistor TR2 varies depending upon the variation of the current-voltage characteristic illustrated in FIG. 6. Consequently, in this instance, current flowing through the organic EL device 8 gradually decreases by use of the display apparatus 11, and the emission luminance of the organic EL device 8 gradually drops. Further, with the configuration shown in FIG. 7, the emission luminance disperses among the pixels depending upon the dispersion of the characteristic of the transistor TR2. It is to be noted that the dispersion of the emission luminance disturbs uniformity of the display screen image and is perceived by irregularity and surface roughness of the display screen image.

Therefore, it seems a possible idea, for example, to form each pixel in such a manner as seen in FIG. 8 as a countermeasure for preventing such a drop of the emission luminance by secular change and a dispersion of the emission luminance by a dispersion in characteristic of an organic EL device as described above.

Referring to FIG. 8, in a display apparatus 21 shown, a display section 22 is formed such that pixels 23 are disposed in a matrix. Each of the pixels 23 includes a signal level storage capacitor C1, which is connected at a first terminal thereof to the anode of an organic EL device 8 and at a second terminal thereof to a signal line SIG through a transistor TR1 which operates on and off in response to a writing signal WS. Consequently, in each pixel 23, the potential at the second terminal of the signal level storage capacitor C1 is set to the signal level of the signal line SIG.

In the pixel 23, the signal level storage capacitor C1 is connected at the opposite terminals thereof to the source and the gate of the transistor TR2, and the transistor TR2 is connected at the drain thereof to a scanning line SCN. Consequently, in the pixel 23, the organic EL device 8 is driven by the transistor TR2 of a source follower configuration wherein the gate electrode of the transistor TR2 is set to the signal level of the signal line SIG. It is to be noted that reference character Vcat in FIG. 8 denotes the cathode potential of the organic EL device 8.

In the display apparatus 21, a write scanning circuit (WSCN) 24A and a drive scanning circuit (DSCN) 24B of a vertical driving circuit 24 output a writing signal WS and a driving signal DS for power supply to scanning lines SCN while a horizontal selector (HSEL) 25A of a horizontal driving circuit 25 outputs a driving signal Ssig to a signal line SIG thereby to control operation of the pixel 23.

FIG. 9 illustrates operation of the pixel 23. Referring to FIG. 9, in the pixel 23, the transistor TR1 is set to an off state in response to the writing signal WS as seen in FIG. 10 and the power supply Vcc is supplied to the transistor TR2 in response to the driving signal DS for a light emission period for which light is emitted from the organic EL device 8 (FIGS. 9A and 9B). Consequently, in the pixel 23, the gate voltage Vg and the source voltage Vs (FIGS. 9D and 9E) of the transistor TR2 are held at the voltages at the opposite terminals of the signal level storage capacitor C1, and the organic EL device 8 is driven by drain-source current Ids which depends upon the gate voltage Vg and the source voltage Vs. It is to be noted that the drain-source current Ids is represented by the expression (1) given hereinabove.

When the light emission period of the pixel 23 ends, the drain voltage of the transistor TR2 drops to a predetermined voltage Vss in response to the driving signal DS as seen in FIG. 11. The predetermined voltage Vss here is set to a voltage lower then a voltage of the sum of the cathode voltage Vcat to the threshold voltage Vthe1 of the organic EL device 8. Consequently, in the pixel 23, the driving signal DS side of the transistor TR2 for driving functions as the source, and the anode voltage (source voltage Vs in FIG. 9) of the organic EL device 8 drops and the organic EL device 8 stops the emission of light.

At this time, in the pixel 23, stored charge is discharged from the side of the signal level storage capacitor C1 adjacent the organic EL device 8 as indicated by an arrow mark in FIG. 11, and consequently, the anode voltage of the organic EL device 8 drops and is set to the predetermined voltage Vss.

Then, in the pixel 23, as seen in FIG. 12, the signal line SIG is dropped to a predetermined voltage Vofs in response to the driving signal Ssig, and the transistor TR1 is changed over to an on state in response to the writing signal WS (FIGS. 9A and 9C). Consequently, in the pixel 23, the gate voltage Vg of the transistor TR2 is set to the predetermined voltage Vofs of the signal line SIG, and the gate-source voltage Vgs of the transistor TR2 is set to Vofs−Vss. Where the threshold voltage of the transistor TR2 is represented by Vth, the voltage Vofs is set such that the gate-source voltage Vgs (Vofs−Vss) of the transistor TR2 is higher than the threshold voltage Vth of the transistor TR2.

Then in the pixel 23, while the transistor TR1 remains in an on state within a period indicated by reference character Tth1 in FIG. 9, the drain voltage of the transistor TR2 is raised to the power supply Vcc in response to the driving signal DS. Consequently, in the pixel 23, when the voltage across the signal level storage capacitor C1 is higher than the threshold voltage of the transistor TR2, charging current flows to the terminal of the signal level storage capacitor C1 adjacent the organic EL device 8 from the power supply Vcc through the transistor TR2 as indicated by an arrow mark in FIG. 13, and the source voltage Vs of the signal level storage capacitor C1 adjacent the organic EL device 8 gradually rises. Here, the equivalent circuit of the organic EL device 8 is represented by a parallel circuit of a diode and a capacitance Ce1. In the situation illustrated in FIG. 13, current flows also to the organic EL device 8 from the transistor TR2 through the power supply Vcc. However, as far as the voltage across the organic EL device 8 does not exceed the threshold voltage of the organic EL device 8 by a rise of the source voltage of the transistor TR2, the leak current of the organic EL device 8 is considerably lower than the current of the transistor TR2. Therefore, current flowing to the organic EL device 8 is used to charge the signal level storage capacitor C1 and the capacitance Ce1 of the organic EL device 8. Accordingly, in the pixel 23, the organic EL device 8 does not emit light, but only the source voltage of the transistor TR2 merely rises.

In the pixel 23, the transistor TR1 is subsequently changed over into an off state by the writing signal WS, and the signal level of the signal line SIG is set to a signal level Vsig indicative of a gradation of the corresponding pixel of a next adjacent line. Consequently, in the pixel 23, charging current from the power supply Vcc through the transistor TR2 flows to the terminal of the signal level storage capacitor C1 adjacent the organic EL device 8, and the source voltage Vs of the transistor TR2 continues to rise. Further, in this instance, the gate voltage Vg of the transistor TR2 rises following up the rise of the source voltage Vs. It is to be noted that the signal level Vsig of the signal line SIG during the period is used for gradation setting of the pixel in the next adjacent line.

In the pixel 23, after a fixed interval of time passes, the signal level of the signal line SIG is changed over to the voltage Vofs. Consequently, in a state wherein the potential at the terminal of the signal level storage capacitor C1 adjacent the signal line SIG is held at the voltage Vofs for a period of time indicated by reference character Tth2 in FIG. 9, when the voltage across the signal level storage capacitor C1 is higher than the threshold voltage of the transistor TR2, charging current flows to the terminal of the signal level storage capacitor C1 adjacent the organic EL device 8 though the transistor TR2 by the power supply Vcc. Consequently, the source voltage Vs of the transistor TR2 gradually rises. As a result, the source voltage Vs gradually rises so that the gate-source voltage Vgs of the transistor TR2 approaches the threshold voltage Vth of the transistor TR2 as seen in FIG. 14. Then, when the gate-source voltage Vgs of the transistor TR2 becomes equal to the threshold voltage Vth of the transistor TR2, the flowing in of the charge current through the transistor TR2 stops.

In the pixel 23, the supplying process of charging current to the terminal of the signal level storage capacitor C1 adjacent the organic EL device 8 through the transistor TR2 is repeated by a number of times sufficient for the gate-source voltage Vgs of the transistor TR2 to reach the threshold voltage Vth of the transistor TR2 (n the example of FIG. 9, three times indicated by reference characters Tth1, Tth2 and Tth3). Consequently, as seen in FIG. 15, the threshold voltage Vth of the transistor TR2 is set to the signal level storage capacitor C1. It is to be noted that the voltages Vofs and Vcat in the pixel 3 are set such that Ve1=Vofs−Vth≦Vcat+Vthe1 in a state wherein the threshold voltage Vth of the transistor TR2 is set to the signal level storage capacitor C1 so that the organic EL device 8 does not emit light. It is to be noted that Vthe1 is the threshold voltage of the organic EL device 8, and Ve1 is the voltage at the terminal of the organic EL device 8 adjacent the transistor TR2.

In the pixel 23, when the potential at the terminal of the signal level storage capacitor C1 adjacent the signal line SIG is set to the voltage Vsig which designates an emission luminance of the organic EL device 8, a voltage representative of a gradation is set to the signal level storage capacitor C1 so as to cancel the threshold voltage Vth of the transistor TR2. Consequently, a dispersion of the emission luminance caused by a dispersion of the threshold voltage Vth of the transistor TR2 is prevented.

In particular, in the pixel 23, as seen in FIG. 16, after the period Tth3 passes, the signal level of the signal line SIG is set to the signal level Vsig designating an emission luminance of the pixel 23. Then, as seen from a period Tμ, the transistor TR1 is set to an on state by the writing signal WS. Consequently, in the pixel 23, the terminal of the signal level storage capacitor C1 adjacent the signal line SIG is set to the signal level Vsig of the signal line SIG, and current corresponding to the gate-source voltage Vgs defined by the voltage across the signal level storage capacitor C1 flows from the power supply Vcc to the terminal of the organic EL device 8 adjacent the signal level storage capacitor C1 through the transistor TR2. Consequently, the source voltage Vs of the transistor TR2 gradually rises.

The current flowing in through the transistor TR2 varies in response to the mobility of the transistor TR2. Consequently, as seen in FIG. 17, as the mobility of the transistor TR2 increases, the rising speed of the source voltage Vs of the transistor TR2 increases. Also the current of the transistor TR2 for driving the organic EL device 8 increases in response to the mobility. Here, the transistor TR2 is a polycrystalline silicon TFT or the like and is disadvantageous in that the dispersion of the threshold voltage Vth and the mobility μ is great.

Consequently, in the pixel 23, in a state wherein the voltage at the terminal of the signal level storage capacitor C1 adjacent the signal line SIG is held at the signal level Vsig of the signal line SIG for the fixed period of time indicated by reference character Tμ, the transistor TR2 is turned on so that charging current flows to the terminal of the signal level storage capacitor C1 adjacent the organic EL device 8. Consequently, the voltage across the signal level storage capacitor C1 is dropped by an amount corresponding to the mobility of the transistor TR2 thereby to prevent a dispersion of the emission luminance by a dispersion of the mobility of the transistor TR2 is prevented.

In the pixel 23, after the fixed period Tμ passes, the transistor TR1 is turned off by the writing signal WS, and the signal level Vsig of the signal line SIG is held by the signal level storage capacitor C1 and a light emitting period starts. It is to be noted that, from those, the driving signal Ssig of the signal line SIG has the signal level Vsig which successively indicates the gradation of the pixels connected to one signal line and repeats across the predetermined voltage Vofs.

However, where the configuration shown in FIG. 8 is used to drive the organic EL device 8 by means of the transistor TR2 in a state wherein the signal level storage capacitor C1 is kept connected to the signal line SIG for the fixed period Tμ to correct for the dispersion of the mobility of the transistor TR2, there is a problem that excess or deficiency occurs with correction for the dispersion of the mobility in response to the signal level of the signal line SIG and this deteriorates the picture quality.

In particular, where the white gradation is displayed as seen in FIG. 18, the signal level of the signal line SIG is held at a signal level relatively high with respect to that where a gray gradation is displayed, and the rising speed of the source voltage Vs is higher than that where a gray gradation is displayed. Consequently, as seen from a period TW, the dispersion of the mobility of the transistor TR2 can be corrected for in a short period of time. It is to be noted that, in FIG. 18, variations of the source voltage Vs where the mobility is high and low are indicated by curves L3 and L4, respectively.

In contrast, where a gray gradation is displayed, the signal level of the signal line SIG is held at a relatively low signal level in comparison with that where the white gradation is displayed, and the rising speed of the source voltage Vs is lower than that where the white gradation is displayed. Consequently, as seen from a period TG, a long period is required to correct for the dispersion of the mobility of the transistor TR2.

One of possible methods to solve this problem is to raise the signal level of the signal line SIG from the fixed voltage Vofs to the signal level Vsig corresponding to an emission luminance across a predetermined voltage Vofs2 within the period Tμ within which the dispersion of the mobility is corrected for as seen from FIG. 19 in contrast to FIG. 9. It is to be noted that the voltage Vofs2 is set to a signal level of an intermediate gradation substantially at the center between the white level and the black level. It is to be noted that, in the configuration of FIG. 19, also within the periods Tth1, Tth2 and Tth3 within which the dispersion of the threshold value is corrected for, the signal waveform of the signal line SIG is set same as that within the period Tμ within which the dispersion of the mobility is corrected for. Consequently, the configuration of the horizontal driving circuit is simplified.

By the countermeasure described above, where the white gradation is displayed as seen in FIG. 20, time t1 required for dispersion correction of the mobility of the transistor TR2 can be made longer than that where the example of FIG. 9 is used. It is to be noted that a curve L9 in FIG. 20 illustrates a variation of the source voltage Vs where the configuration of FIG. 9 is used. Meanwhile, FIG. 21 illustrates a variation of the source voltage Vs and the gate voltage Vg where the configuration of FIG. 9 is used in contrast to FIG. 20.

Further, as seen in FIG. 22, where a gray gradation is displayed, time t2 required for dispersion correction of the mobility of the transistor TR2 can be made shorter when compared with that where the example of FIG. 9 is used. It is to be noted that, in FIG. 22, a curve L9 indicates a variation of the source voltage Vs where the configuration of FIG. 9 is used. Further, FIG. 23 illustrates a variation of the source voltage Vs and the gate voltage Vg in the case of the configuration of FIG. 9 for comparison with FIG. 22.

Consequently, if the dispersion of the mobility is corrected for in such a manner that the signal level of the signal line SIG is raised from the predetermined voltage Vofs to the signal level Vsig corresponding to an emission luminance across the predetermined voltage Vofs2, then even where the emission luminance exhibits various values, the dispersion of the mobility can be corrected for suitably.

However, the present method has a problem that it cannot be applied directly to a system wherein a plurality of signal lines are driven time-divisionally, which is applied widely to a display panel which is configured using TFTs and uses a low frequency polycrystalline silicon process or the like. In particular, FIG. 24 shows a liquid crystal display apparatus wherein a plurality of signal lines are driven time-divisionally. Referring to FIG. 24, in the example illustrated, signal lines SIGR, SIGG and SIGB connected to pixels 33R, 33G and 33B for red, green and blue, respectively, are driven time-divisionally by one driving signal Ssig. Therefore, the driving signal Ssig is supplied to the signal lines SIGR, SIGG and SIGB through switch circuits TR, TG and TB, respectively. Further, as seen from FIGS. 25A to 25D, the switch circuits TR, TG and TB are successively changed over to an on state so that gradations of the pixels 33R, 33G and 33B for red, green and blue connected to the signal lines SIGR, SIGG and SIGB are set by the one driving signal Ssig.

If the system of driving a plurality of signal lines through one driving system is applied to a liquid crystal display panel of the configuration shown in FIG. 19, then as seen from FIG. 26A, the driving signal Ssig common to the plurality of signal lines is set to the fixed voltage Vofs first and then to the second voltage Vofs2, whereafter it is successively set to potentials VsigR, VsigG and VsigB to the pixels 33R, 33G and 33B for red, green and blue.

Further, the switch circuits TR, TG and TB of the signal lines SIGR, SIGG and SIGB are kept in an on stage within the periods of the predetermined voltage Vofs and Vofs2, and thereafter, they are successively placed into an on state within a period within which the signal level of the driving signal Ssig is set to the potentials VsigR, VsigG or VsigB of the corresponding pixel (FIGS. 26B to 26D). Consequently, the signal levels of the signal lines SIGR, SIGG and SIGB are held at potentials which are those immediately before the switch circuits TR, TG and TB are placed into an off state by a floating capacitance thereof and are successively set to the voltages Vofs and Vofs2 and the potentials VsigR, VsigG and VsigB of the corresponding pixels 33R, 33G and 33B.

In the pixels 33R, 33G and 33B, for a period (Th3, Tμ1) within which the signal lines SIGR, SIGG and SIGB are set to the voltages Vofs and Vofs2, the writing signal WS is successively set to an on state, and then is placed into and held in an on state within a fixed period Tμ2 at a point of time at which the signal lines SIGR, SIGG and SIGB are set to the potentials VsigR, VsigG and VsigB of the corresponding pixels 33R, 33G and 33B (FIG. 26E). Consequently, within the period Tμ1 and Tμ2, excess or deficiency of the correction amount by an emission luminance is prevented to correct for the dispersion of the mobility of the transistor TR2.

However, the method described above has a problem that, for a period of time from the period Tμ1 to the period Tμ2, the gate voltage Vg and the source voltage Vs of the transistor TR2 are raised by the gate-source voltage of the transistor TR2 (FIGS. 26F and 26G), and consequently, the dynamic range of the gradation which can be set through the signal line SIG decreases. Further, the method has a problem also that the rise amount of the gate voltage Vg and the source voltage Vs varies also within the period of time from the period Tμ1 to the period Tμ2 and consequently the picture quality is deteriorated. It is to be noted that such degradation of the picture quality is recognized from luminance irregularity of the display screen image or the like.

SUMMARY OF THE INVENTION

Therefore, it is demanded to provide a display apparatus and a driving method for a display apparatus wherein, even where a plurality of scanning lines are driven time-divisionally, decrease of the dynamic range and deterioration of the picture quality can be prevented effectively.

To this end, according to the present invention, the voltage at a first terminal of a signal level storage capacitor is set to a halftone voltage to charge a second terminal of the signal level storage capacitor from a driving transistor. Then, the potential at the first terminal of the signal level storage capacitor is set to a fixed voltage, with which the driving transistor is turned off. Then, the potential at the first terminal of the signal level storage capacitor is set to a gradation voltage, whereby, even where the emission luminance exhibits various values, the dispersion of the mobility of transistors for driving light emitting devices is corrected for appropriately.

In particular, according to a first embodiment of the present invention, there is provided a display apparatus comprising a display section including a plurality of pixels disposed in a matrix and a plurality of signal lines and a plurality of scanning lines, and a horizontal driving circuit and a vertical driving circuit configured to drive the signal lines and the scanning lines of the display section to display an image on the display section, each of the pixels including a light emitting device, a signal level storage capacitor, a writing transistor having a gate to which a wiring signal outputted from the vertical driving circuit is inputted to turn on the writing transistor to set a terminal voltage of the signal level storage capacitor to a signal level of a corresponding one of the signal lines, and a driving transistor having a gate and a source connected to the opposite terminals of the signal level storage capacitor to drive the light emitting device in response to the voltage across the signal level storage capacitor thereby to cause the light emitting device to emit light, the horizontal driving circuit and the vertical driving circuit being operable, within a first period of a no-light emitting period of each of the pixels within which the emission of light of the light emitting device is stopped, to turn on the writing transistor of the pixel to set a voltage at a first one of the terminals of the signal level storage capacitor to a halftone voltage corresponding to a halftone of the light emitting device through the signal line and turn on the driving transistor to charge a second one of the terminals of the signal level storage capacitor from the driving transistor, and within a second period of the no-light emitting period following the first period, to set the potential at the first terminal of the signal level storage capacitor to a fixed voltage, with which the driving transistor is turned off, through the signal line to hold the potential at the second terminal of the signal level storage capacitor to the potential set within the first period, and then within a third period of the no-light emitting period following the second period, to set the potential at the first terminal of the signal level storage capacitor to a gradation voltage corresponding to a gradation with which the light emitting device emits light and turn on the driving transistor to charge the second terminal of the signal level storage capacitor from the driving transistor and then turn off the writing transistor.

According to another embodiment of the present invention, there is provided a driving method for a display apparatus which includes a display section including a plurality of pixels disposed in a matrix and a plurality of signal lines and a plurality of scanning lines, and a horizontal driving circuit and a vertical driving circuit configured to drive the signal lines and the scanning lines of the display section to display an image on the display section, each of the pixels including a light emitting device, a signal level storage capacitor, a writing transistor having a gate to which a wiring signal outputted from the vertical driving circuit is inputted to turn on the writing transistor to set a terminal voltage of the signal level storage capacitor to a signal level of a corresponding one of the signal lines, and a driving transistor having a gate and a source connected to the opposite terminals of the signal level storage capacitor to drive the light emitting device in response to the voltage across the signal level storage capacitor thereby to cause the light emitting device to emit light, the driving method comprising the steps of turning on, within a first period of a no-light emitting period of each of the pixels within which the emission of light of the light emitting device is stopped, the writing transistor of the pixel to set a voltage at a first one of the terminals of the signal level storage capacitor to a halftone voltage corresponding to a halftone of the light emitting device through the signal line and turn on the driving transistor to charge a second one of the terminals of the signal level storage capacitor from the driving transistor, setting, within a second period of the no-light emitting period following the first period, the potential at the first terminal of the signal level storage capacitor to a fixed voltage, with which the driving transistor is turned off, through the signal line to hold the potential at the second terminal of the signal level storage capacitor to the potential set within the first period, and setting, within a third period of the no-light emitting period following the second period, the potential at the first terminal of the signal level storage capacitor to a gradation voltage corresponding to a gradation with which the light emitting device emits light and turn on the driving transistor to charge the second terminal of the signal level storage capacitor from the driving transistor and then turn off the writing transistor.

In the display apparatus and the driving method for a display apparatus, within the first period of a no-light emitting period, the voltage at the first terminal of the signal level storage capacitor is set to a halftone voltage and the driving transistor is turned on to charge the second terminal of the signal level storage capacitor. Then, within the subsequent second period of the no-light emitting period, the potential at the first terminal of the signal level storage capacitor is set to the fixed voltage, with which the driving transistor is turned off, to hold the potential at the second terminal of the signal level storage capacitor to the potential set within the first period. Then, within the following third period of the no-light emitting period, the potential at the first terminal of the signal level storage capacitor is set to a gradation voltage corresponding to a gradation with which the light emitting device emits light, and the driving transistor is turned on to charge the second terminal of the signal level storage capacitor, whereafter the writing transistor is turned off. Consequently, even where the emission luminance exhibits various values, the dispersion of the mobility of the driving transistor is corrected for appropriately within the first and third periods, and the second period which does not have an influence on the dispersion correction of the mobility at all an be provided between the first and third periods. Accordingly, within the second period, even where a plurality of scanning lines are driven time-divisionally, decrease of the dynamic range and degradation of the picture quality can be prevented effectively.

In this manner, with the display apparatus and driving method for a display apparatus, even where the emission luminance exhibits various values, the dispersion of the mobility of the transistor for driving the light emitting device is corrected for appropriately, and even where a plurality of scanning lines are driven time-divisionally, decrease of the dynamic range and degradation of the picture quality can be prevented effectively.

BRIEF DESCRIPTION OF THE DRAWINGS

FIG. 24 is a block diagram showing a display apparatus wherein a plurality of signal lines are driven time-divisionally;

FIGS. 25A to 25D are time charts illustrating operation of the display apparatus of FIG. 24.

DETAILED DESCRIPTION OF THE PREFERRED EMBODIMENTS

Figures 1A, 1B, 1C, 1D, 1E, 1F, 1G:
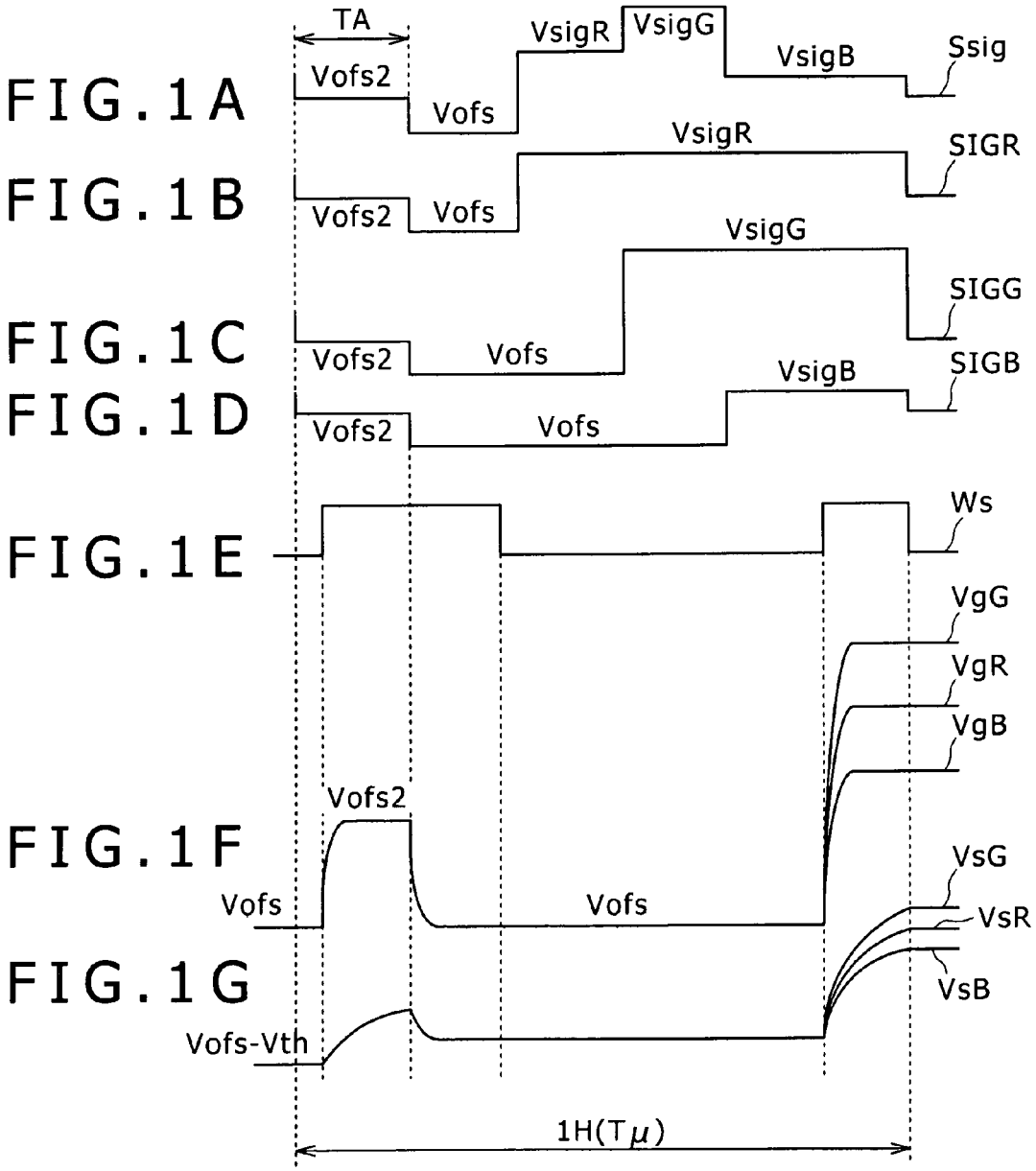
FIGS. 1A to 1G are time charts illustrating driving of pixels of a display apparatus according to a first embodiment of the present invention.

Now, embodiments of the present invention will be described in detail below, referring to the drawings.

First Embodiment

1. Configuration of the Embodiment

FIGS. 1A to 1G are time charts illustrating driving timings of pixels in a display apparatus according to a first embodiment of the present invention for comparison with FIGS. 26A to 26G. The display apparatus of the present embodiment has a configuration same as that of the display apparatus described hereinabove with reference to FIG. 24 except that driving of pixels within a no-light emitting period is different. Therefore, in the following description, the configuration of the display apparatus described above is suitably referred to.

In the operation illustrated in FIGS. 1A to 1G, a driving signal production circuit not shown (refer to FIG. 24) produces one driving signal Ssig common to adjacent pixels 33R, 33G and 33B for red, green and blue which form one pixel of a color image. The driving signal Ssig is outputted to the signal lines SIGR, SIGG and SIGB of the corresponding pixels 33R, 33G and 33B for red, green and blue through the switch circuits TR, TG and TB to time-divisionally drive the three signal lines SIGR, SIGG and SIGB.

In the present embodiment, a period Tμ within which the mobility is to be corrected is allocated to one horizontal scanning period 1H as seen from FIG. 1A. Within a first period TA at the to of the period Tμ for the mobility correction, the driving signal Ssig is set to a halftone voltage Vofs2 corresponding to a halftone between the highest emission luminance and the lowest emission luminance. For a subsequent fixed period of time, the driving signal Ssig is set to a fixed voltage Vofs for causing the transistor TR2 to turn off.

It is to be noted here that, in the present embodiment, the dispersion of the threshold voltage of the transistor TR2 is corrected for in advance to set the source voltage Vs to the voltage Vofs−Vth in a similar manner as described hereinabove within a no-light emitting period, and thereafter, the gate voltage Vg of the transistor TR2 is set within the first period TA to cause the source voltage of the transistor TR2 to rise. Consequently, the fixed voltage Vofs used for the correction of the threshold voltage Vth is allocated to the fixed voltage Vofs for causing the transistor TR2 within the period for the correction of the motility to turn off. Accordingly, various voltages can be applied as the fixed voltage for causing the transistor TR2 to turn off only if they are lower than the fixed voltage Vofs used for the correction of the threshold voltage.

Then, the driving signal Ssig is successively set to the gradation voltages VsigR, VsigG and VsigB corresponding to the gradations of the pixels 33R, 33G and 33B for red, green and blue. The driving signal Ssig repeats the signal waveform for the period Tμ for correction of the mobility, and in the display apparatus of the present embodiment, the gradation of the pixels is set line-sequentially in accordance with the repetitions of the signal waveform of the driving signal Ssig. Consequently, the correction period for the mobility for setting of the gradation of three successive lines is utilized for dispersion correction of the threshold voltage of a succeeding one line.

Accordingly, immediately before the period for correction of the mobility, in each of the pixels 33R, 33G and 33B for which the correction of the mobility is carried out, the transistor TR1 is set to an on state and the gate voltage Vg of the transistor TR2 is set to the fixed voltage Vofs within a period within which the driving signal Ssig is set to the fixed voltage Vofs by the threshold voltage correction process within three horizontal scanning periods. Thereafter, the transistors TR1 and TR2 are set to an off state and an on state, respectively, so that the potential across the signal level storage capacitor C1 is set to the threshold voltage Vth of the transistor TR2.

This display apparatus is controlled such that, within periods within which, after the switch circuits TR, TG and TB for the signal lines SIGR, SIGG and SIGB are turned on within a period within which the driving signal Ssig remains set to the halftone voltage Vof2 or the fixed voltage Vofs, the corresponding switch circuits TR, TG and TB exhibit an on state within a period within which the driving signal Ssig is set to the signal levels of the corresponding pixels. Consequently, the signal lines SIGR, SIGG and SIGB are successively set to the halftone voltage Vofs2 and the fixed voltage Vofs and held at the fixed voltage Vofs. Thereafter, the signal lines SIGR, SIGG and SIGB are set to the signal levels VsigR, VsigG and VsigB of the corresponding pixels, respectively. It is to be noted that, within the period within which the signal lines SIGR, SIGG and SIGB are set to the signal levels VsigR, VsigG and VsigB after they are set to the fixed voltage Vofs, they are held at the fixed voltage Vofs by their floating capacitance.

Figure 20:
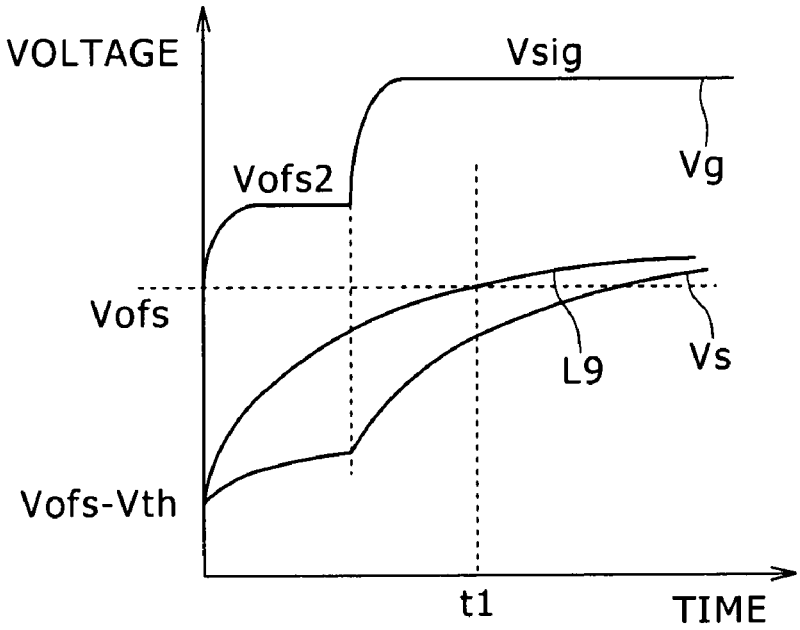
FIG. 20 is a signal waveform diagram illustrating correction for the dispersion of the mobility wherein a voltage for a halftone is used where the white gradation is displayed.
Figure 21:
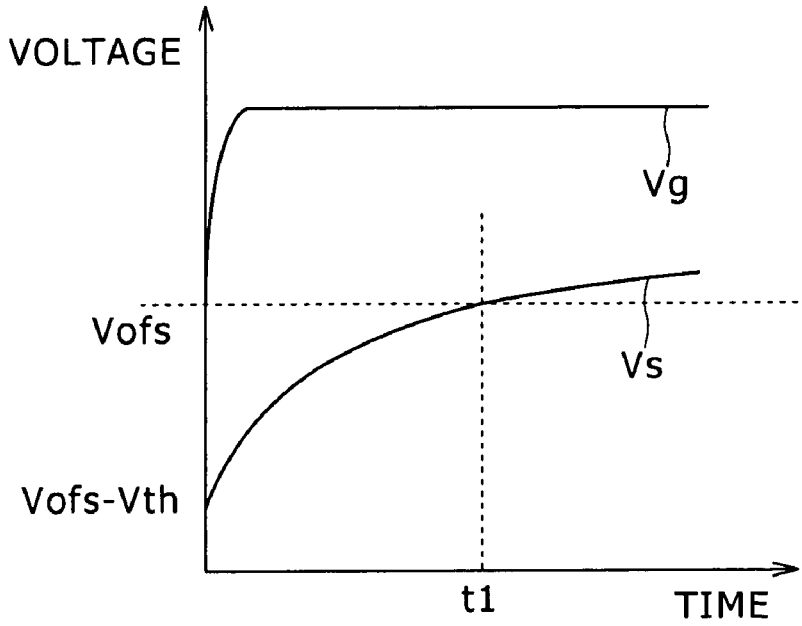
FIG. 21 is a similar view but illustrating correction for the dispersion of the mobility wherein a voltage for a halftone is not used for comparison with FIG. 20.
Figure 22:
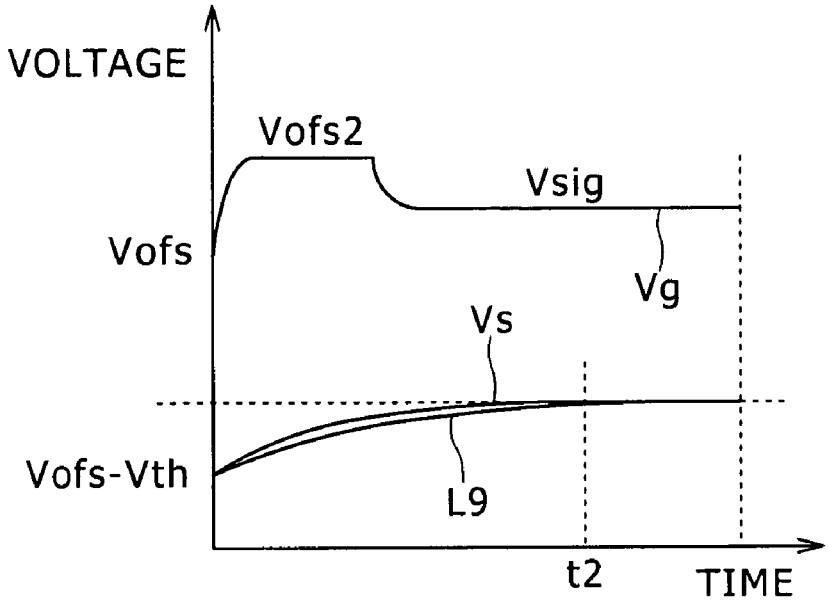
FIG. 22 is a similar view but illustrating correction for the dispersion of the mobility wherein a voltage for a halftone is not used where a gray gradation is used.
Figure 23:
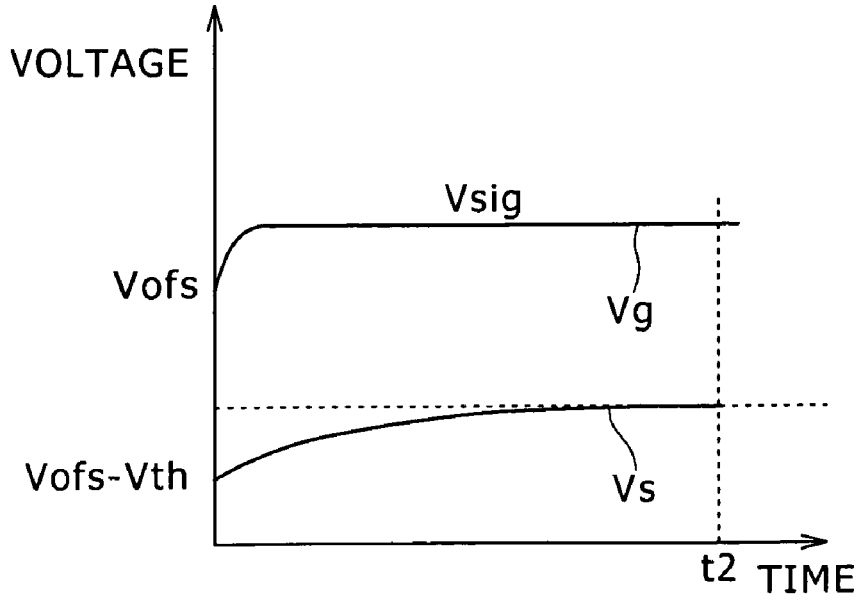
FIG. 23 is a similar view but illustrating correction for the dispersion of the mobility wherein a voltage for a halftone is not used for comparison with FIG. 22.
Figures 26A, 26B, 26C, 26D, 26E, 26F, 26G:
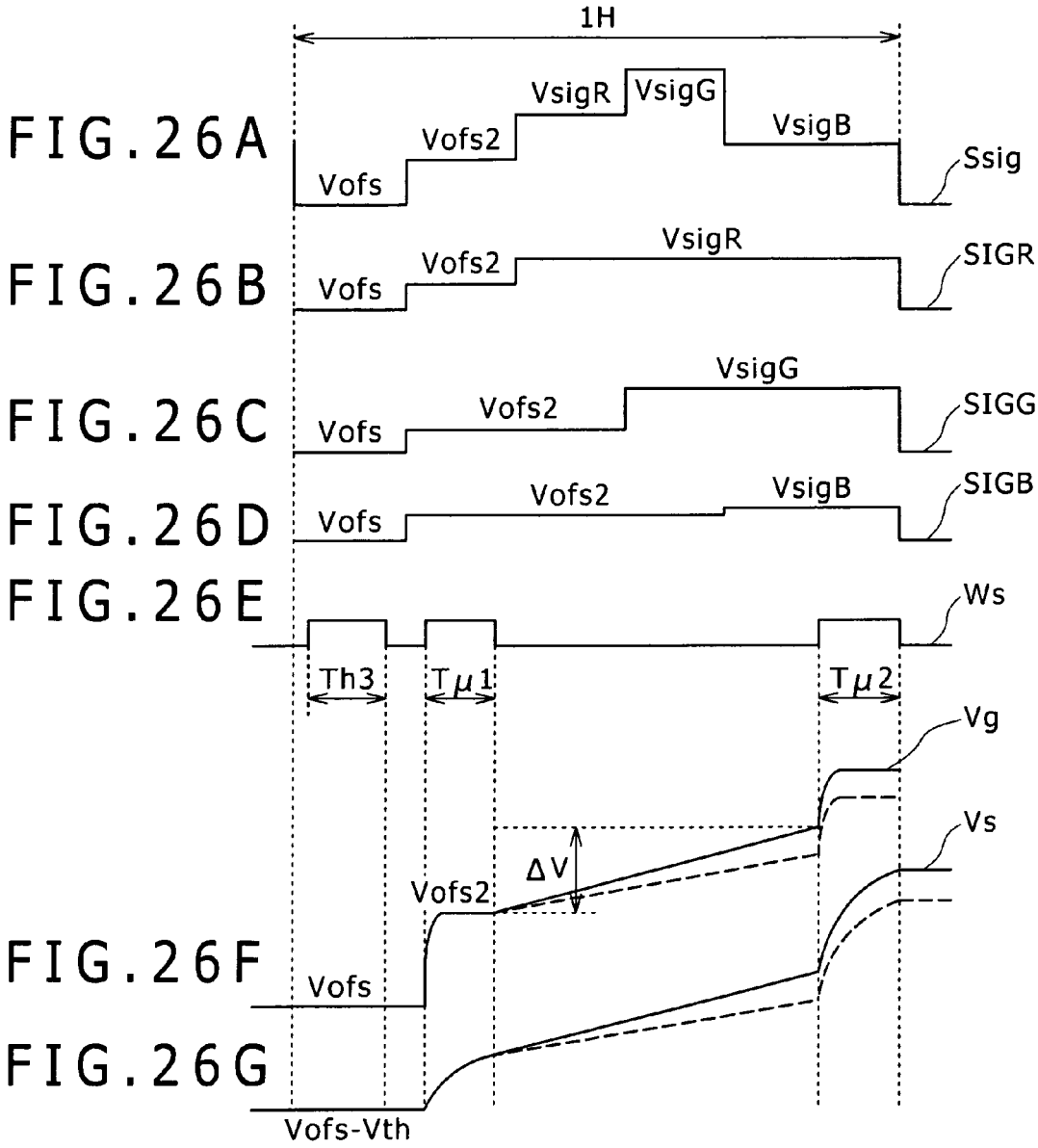
FIGS. 26A to 26G are signal waveforms illustrating correction for the dispersion of the mobility where a plurality of signal lines are driven time-divisionally to use a voltage for a halftone.

In the present display apparatus, within a period within which the signal lines SIGR, SIGG and SIGB are set to the halftone voltage Vofs2 and the fixed voltage Vofs, the signal level of the writing signal WS is raised to set the transistor TR1 to an on state. Consequently, the gate voltage Vg and the source voltage Vs of the transistor TR2 are raised to a voltage corresponding to the halftone voltage Vofs2 thereby to correct for the dispersion of the mobility of the transistor TR2 with the halftone voltage Vofs2 (refer to FIGS. 20 to 22). Thereafter, the transistor TR2 is placed into an off state and the gate voltage Vg and the source voltage Vs of the transistor TR2 are held at their voltages whose dispersion of the mobility is corrected for with the halftone voltage Vofs2 (FIGS. 1E to 1G).

Thereafter, in the display apparatus, in a state wherein the three signal lines SIGR, SIGG and SIGB are set to the corresponding gradation voltages VsigR, VsigG and VsigB, respectively, the transistor TR1 is set to an on state for a fixed period of time by the writing signal WS, and consequently, the dispersion of the mobility of the transistor TR2 is corrected for finally. Thereafter, the gradation voltages VsigR, VsigG and VsigB are held by the respective signal level storage capacitors C1, and within a succeeding light emission period, the pixels emit light with emission luminances held in the signal level storage capacitors C1.

2. Operation of the Embodiment

In the display apparatus of the present embodiment (refer to FIGS. 8 to 16) having the configuration described above, the signal level Vsig of a signal line SIG is set to a pixel 23 of the display section 22 successively in a unit of a line by driving of the signal line SIG and the scanning line SCN by the horizontal driving circuit and the vertical driving circuit. Further, the organic EL devices 8 of the pixels 23 emit light with the set signal levels Vsig so that a desired image is displayed on the display section 22.

In particular, in the present display apparatus, within a no-light emitting period, the first terminal of the signal level storage capacitor C1 is set to the signal level Vsig of the signal line SIG. Then, within a light emitting period, the organic EL device 8 of each pixel 23 is driven by the transistor TR2 with the gate-source voltage Vgs provided by the voltage across the signal level storage capacitor C1. Consequently, on the present display apparatus, the organic EL device 8 of each pixel 23 emits light with an emission luminance according to the signal level Vsig of the signal line SIG.

Figures 9A, 9B, 9C, 9D, 9E:
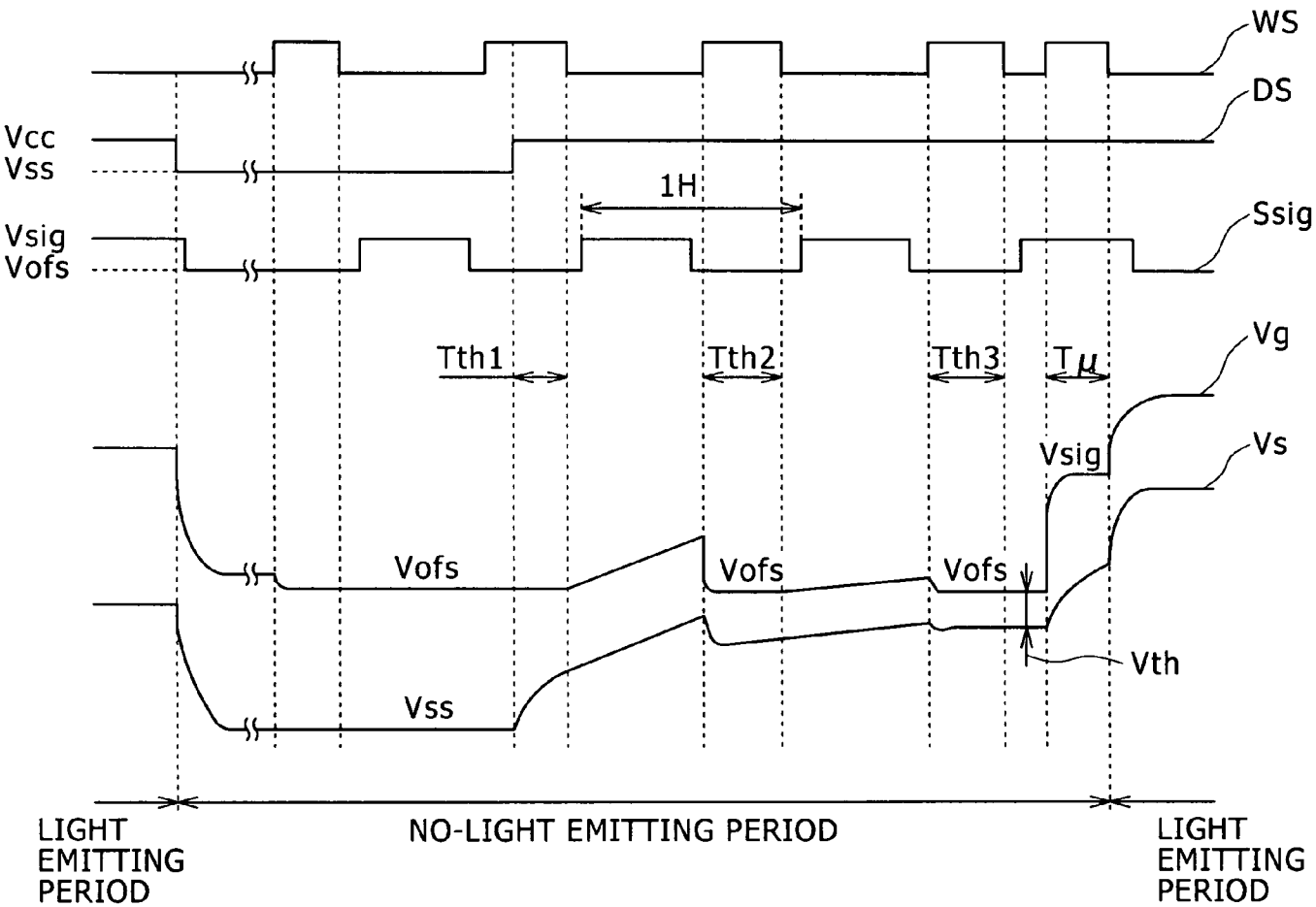
FIGS. 9A to 9E are timing charts illustrating operation of the display apparatus of FIG. 8.
Figure 10:
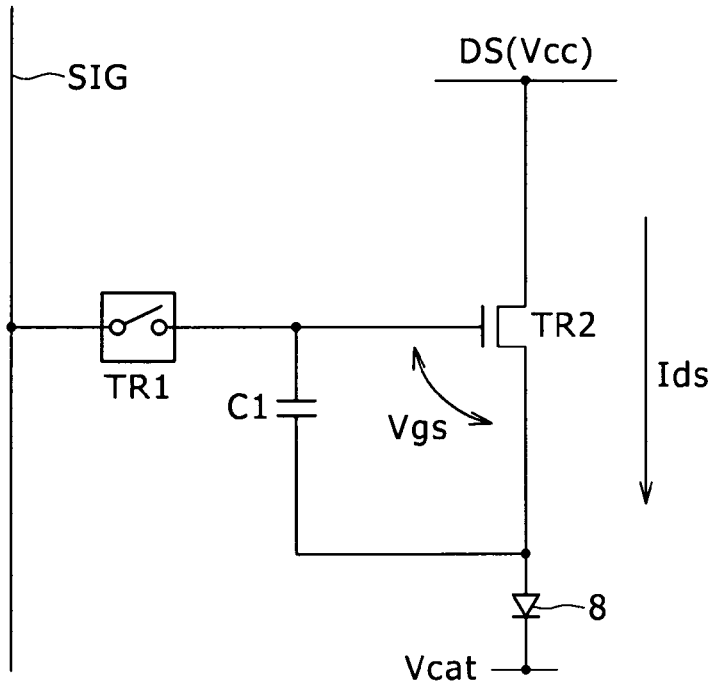
FIGS. 10 to 13 are circuit diagrams illustrating operation of a pixel within a light emission period illustrated in FIGS. 9A to 9E.
Figure 11:
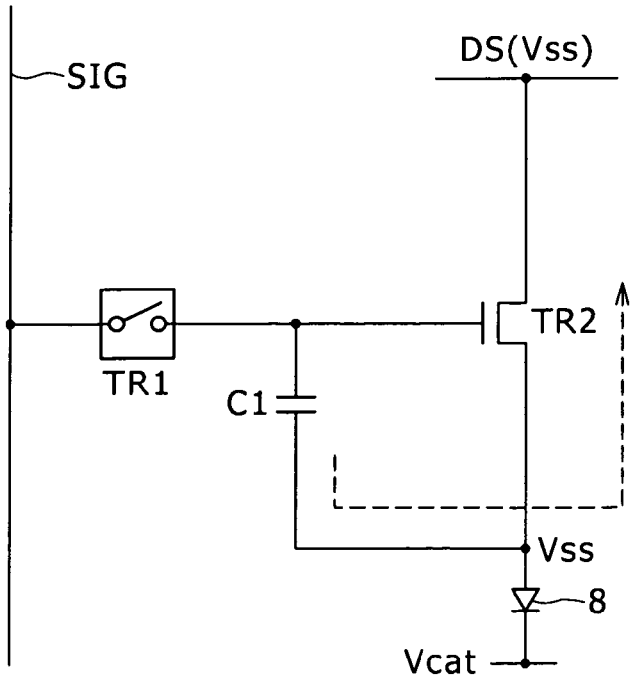
Figure 12:
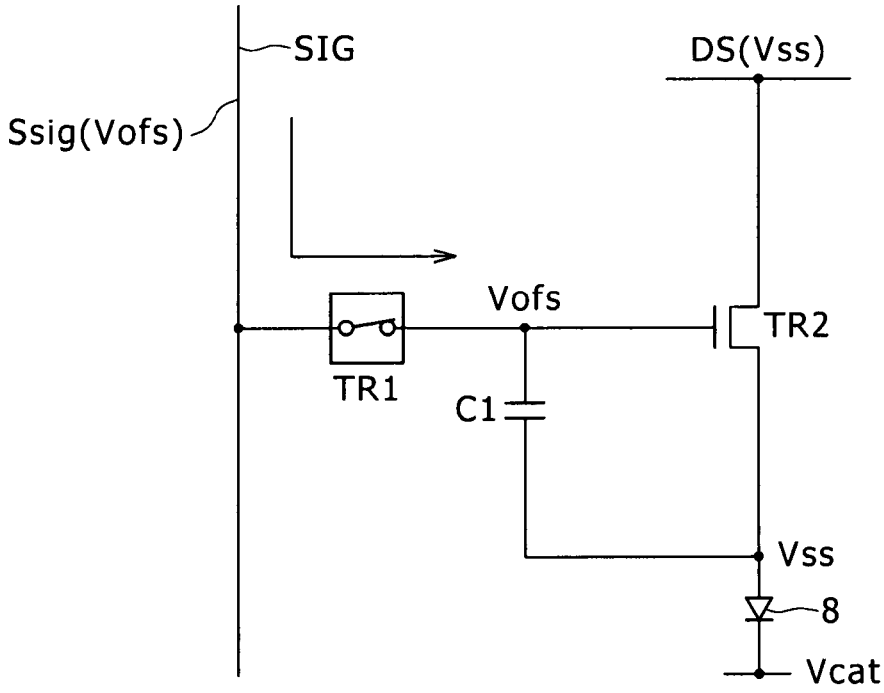
Figure 13:
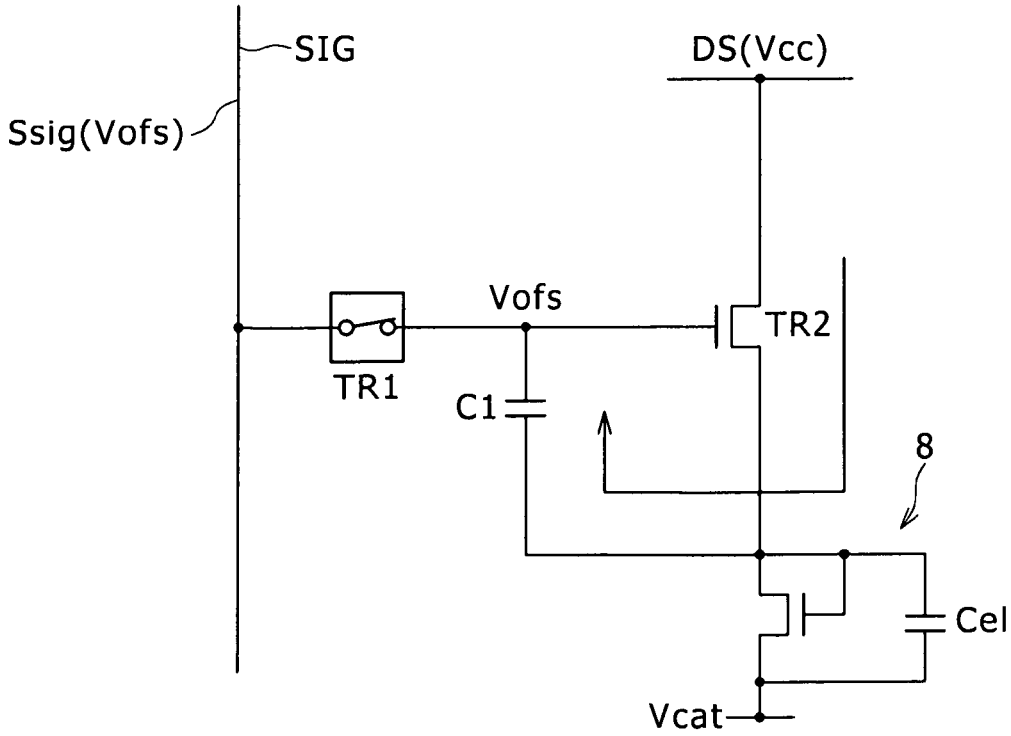

In the display apparatus, within the no-light emitting period described above, the voltage across the signal level storage capacitor C1 is first set to the predetermined fixed voltages Vofs and Vss, and then the threshold voltage Vth of the transistor TR2 is set to the signal level storage capacitor C1 by discharge through the transistor TR2 which drives the organic EL device 8 (refer to periods Tth1, Tth2 and Tth3 of FIG. 9). By this, the dispersion of the emission luminance by the dispersion of the threshold voltage Vth of the transistor TR2 is corrected for.

Thereafter, the transistor TR1 is set to an on state with the writing signal WS to connect the terminal of the signal level storage capacitor C1 adjacent the signal line SIG to the signal line SIG, and in this state, the transistor TR2 is placed into an on state to charge the second terminal of the signal level storage capacitor C1 (within the period Tμ in FIG. 9) thereby to correct for the dispersion of the emission luminance by the dispersion of the mobility of the transistor TR2.

In the display apparatus, after the dispersion correction of the mobility, the operation state of the transistor TR1 is placed into an off state by the writing signal WS. Consequently, the signal level Vsig of the signal line SIG is sample held by the signal level storage capacitor C1 to set the emission luminance of the organic EL device 8.

Figure 18:
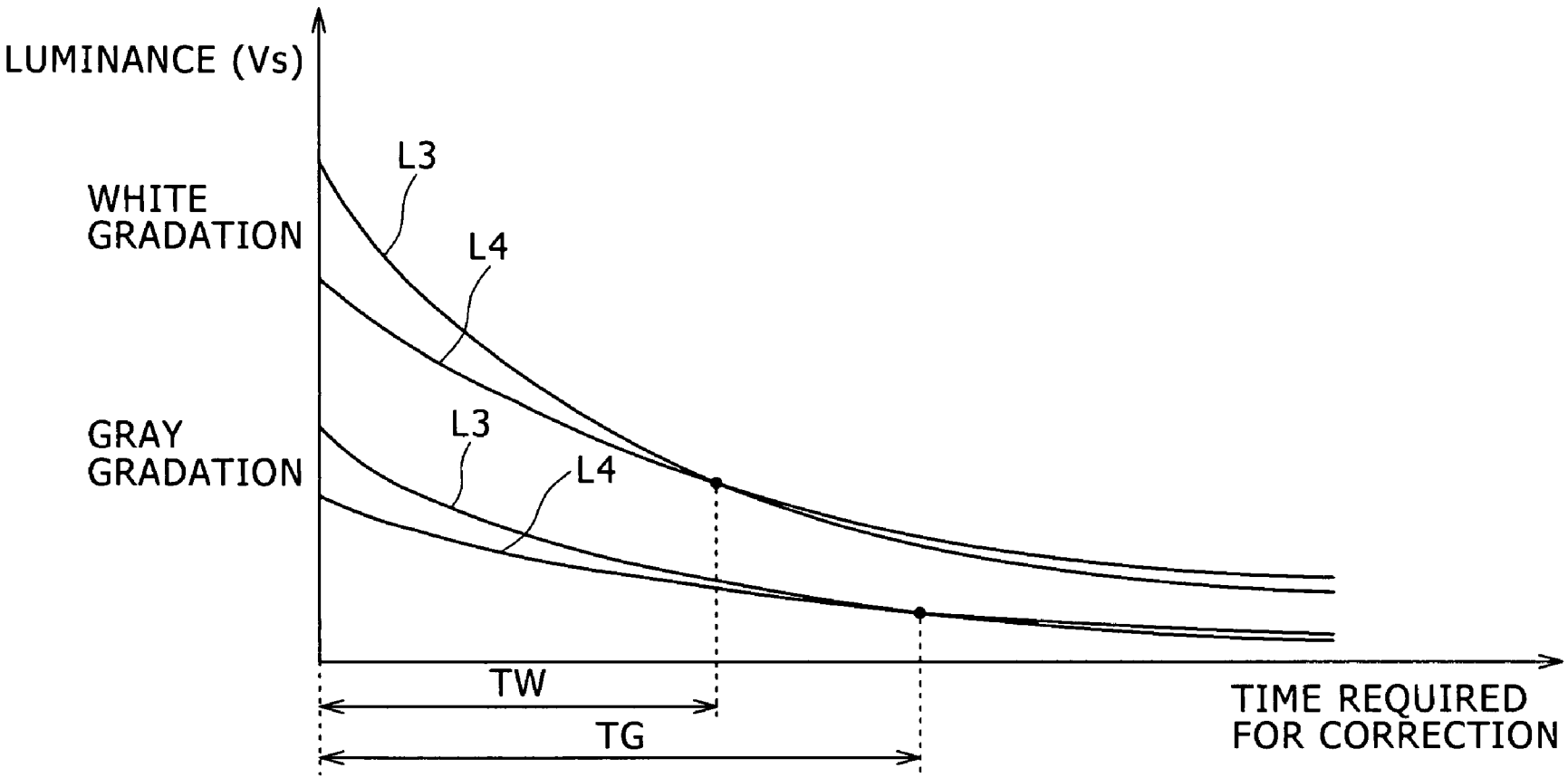
FIG. 18 is a characteristic diagram illustrating time required for correction of the dispersion of the mobility.

However, where the gradation voltage to be set to each pixel is merely set to a signal line SIG to correct for the dispersion of the mobility of the transistor TR2, when the emission luminance is high, the time required for the dispersion correction of the mobility is short, but when the emission luminance is low, the time required for the dispersion correction of the mobility is long. Therefore, with the dispersion correction by a fixed period of time, excess or deficiency in dispersion correction of the mobility occurs depending upon the emission luminance, resulting in deterioration of the picture quality (FIG. 18).

Therefore, in the present embodiment, after the dispersion of the mobility is corrected for first with the halftone voltage Vofs2 corresponding to a halftone between the highest emission luminance and the lowest emission luminance, the dispersion of the mobility is corrected for with the gradation voltage Vsig set finally (FIGS. 19 to 23) thereby to prevent excess or deficiency of the dispersion correction of the mobility according to the emission luminance to prevent deterioration of the picture quality.

However, where the dispersion of the mobility of the transistor TR2 is corrected by the series of the halftone voltage Vofs2 and the gradation voltage Vsig, when a plurality of signal lines are driven time-divisionally, for a period of time after the dispersion of the mobility is corrected for with the halftone voltage Vofs2 until the final dispersion correction of the mobility is started with the gradation voltage Vsig, the gate voltage and the source voltage of the transistor TR2 for driving the organic EL device 8 rise (FIG. 26). Consequently, the mobility cannot be corrected correctly, and the picture quality is deteriorated. Further, the dynamic range of the signal line potential which can be set to the transistor TR2 decreases, and consequently, the dynamic range of the emission luminance decreases.

Therefore, in the present embodiment, the dispersion of the mobility of the transistor TR2 is corrected for with the halftone voltage Vofs2 first, and then the transistor TR2 is placed into an off state with the fixed voltage Vofs, whereafter the dispersion of the mobility of the transistor TR2 is finally corrected for with the gradation voltages VsigR, VsigG and VsigB of the pixels (FIG. 1). Consequently, in the present embodiment, for a period of time after the dispersion of the mobility of the transistor TR2 is corrected for with the halftone voltage Vofs2 until the dispersion of the mobility of the transistor TR2 is finally corrected with the gradation voltages VsigR, VsigG and VsigB of the pixels, the source voltage of the transistor TR2 can be maintained at the voltage whose dispersion of the mobility is corrected for with the halftone voltage Vofs2 so that the dispersion correction of the mobility is not influenced at all by turning off operation of the transistor TR2. Consequently, the dispersion of the mobility of the transistor TR2 can be corrected appropriately at various emission luminances such that, even where a plurality of scanning lines are driven time-divisionally, decrease of the dynamic range can be reduced and deterioration of the picture quality can be prevented effectively.

In short, in the present embodiment, within a period within which the transistor TR2 is in an off state by the halftone voltage Vofs2, the transistor TR1 is turned off to disconnect the transistor TR2 from the signal lines SIGR, SIGG and SIGB to successively set the gradation voltages VsigR, VsigG and VsigB corresponding to the signal lines SIGR, SIGG and SIGB. Further, after the dispersion of the mobility of the transistor TR2 is finally corrected with the gradation voltages VsigR, VsigG and VsigB set to the signal lines SIGR, SIGG and SIGB, the transistor TR1 is turned off to hold the gradation voltages VsigR, VsigG and VsigB in the signal level storage capacitors C1. Consequently, in the display apparatus, within a period of time till a subsequent no-light emitting period, the organic EL device 8 can emit light with the emission luminance which depends upon the gradation voltage VsigR, VsigG or VsigB held in the signal level storage capacitor C1 for a period of time till a subsequent no-light emitting period to display a desired image.

3. Effects of the Embodiment

With the configuration described above, after the voltage at a first terminal of a signal level storage capacitor is set to a halftone voltage to charge the second terminal of the signal level storage capacitor, the voltage at the first terminal of the signal level storage capacitor is set to a fixed voltage at which the driving transistor exhibits an off state, whereafter the voltage at the first terminal of the signal level storage capacitor is set to a gradation voltage. By this, even where the emission luminance exhibits various values, the dispersion of the mobility of the transistor for driving the light emitting device is corrected for appropriately. Consequently, even where a plurality of scanning lines are driven line-sequentially, decrease of the dynamic range and deterioration of the picture quality can be prevented effectively.

Further, since a plurality of scanning lines are driven line-sequentially, the configuration of the horizontal driving circuit and so forth can be simplified.

More particularly, by simultaneously setting a halftone voltage and a fixed voltage to pixels connected to a plurality of signal lines and then setting the signal lines successively to a gradation voltage such that the gradation voltage is held by the capacitance of the signal lines, whereafter gradation voltages are set to the pixels and the scanning lines are driven time-divisionally, decrease of the dynamic range and degradation of the picture quality can be prevented effectively.

Second Embodiment

Figure 2:
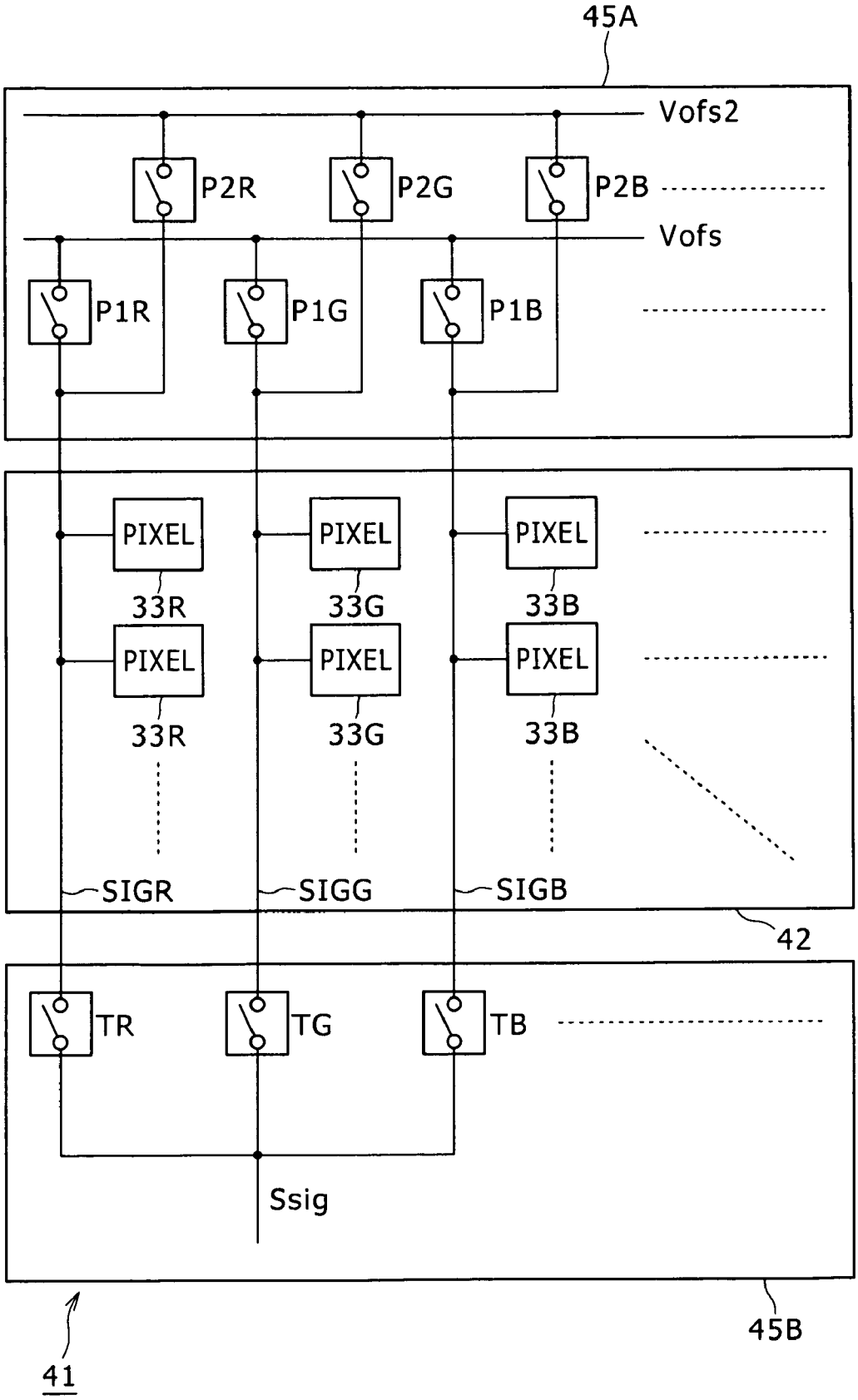
FIG. 2 is a block diagram showing a configuration of a display apparatus according to a second embodiment of the present invention.
Figures 3A, 3B, 3C, 3D, 3E, 3F, 3G, 3H:
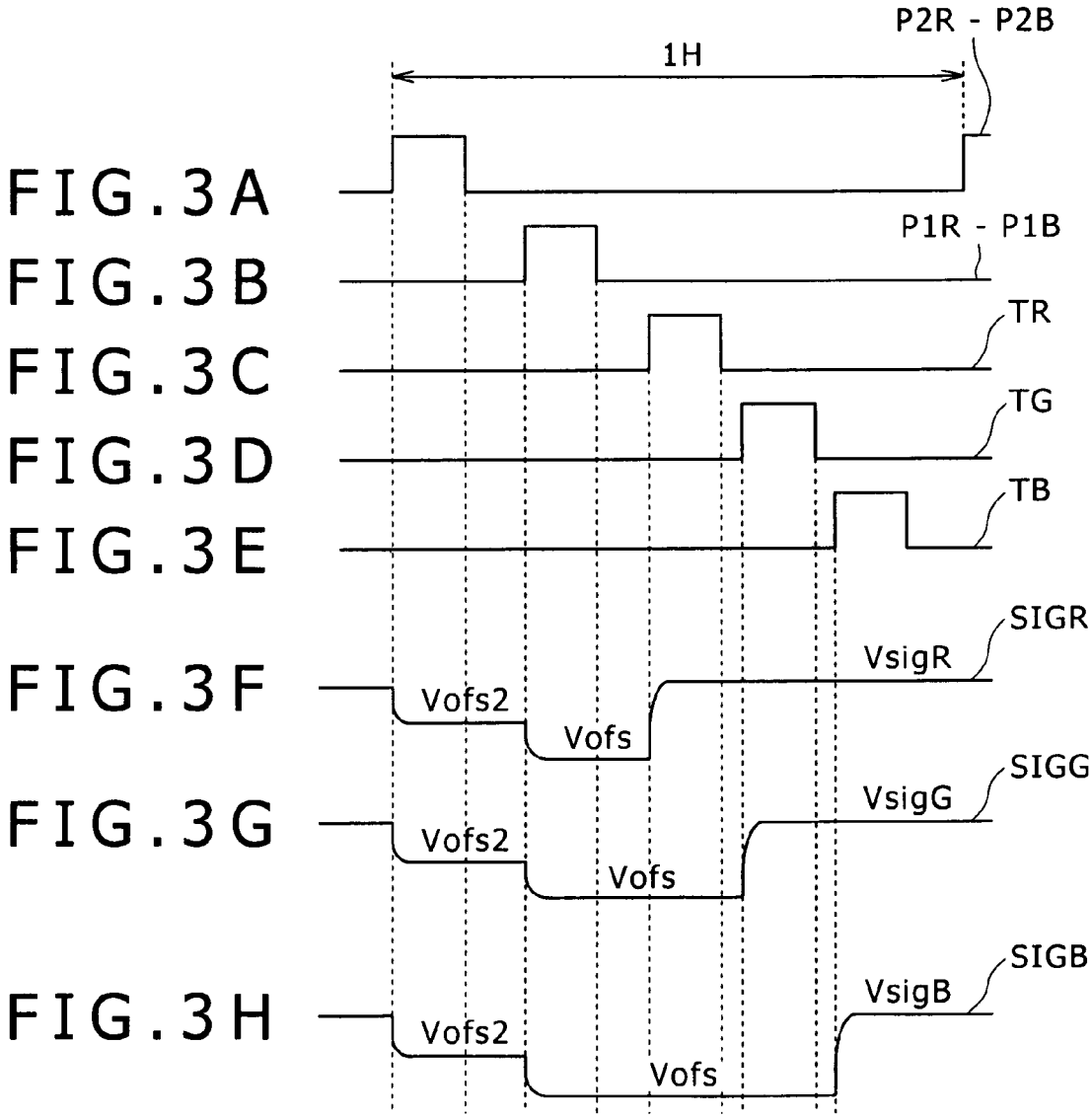
FIGS. 3A to 3H are time charts illustrating operation of the display apparatus of FIG. 2.
Figure 4:
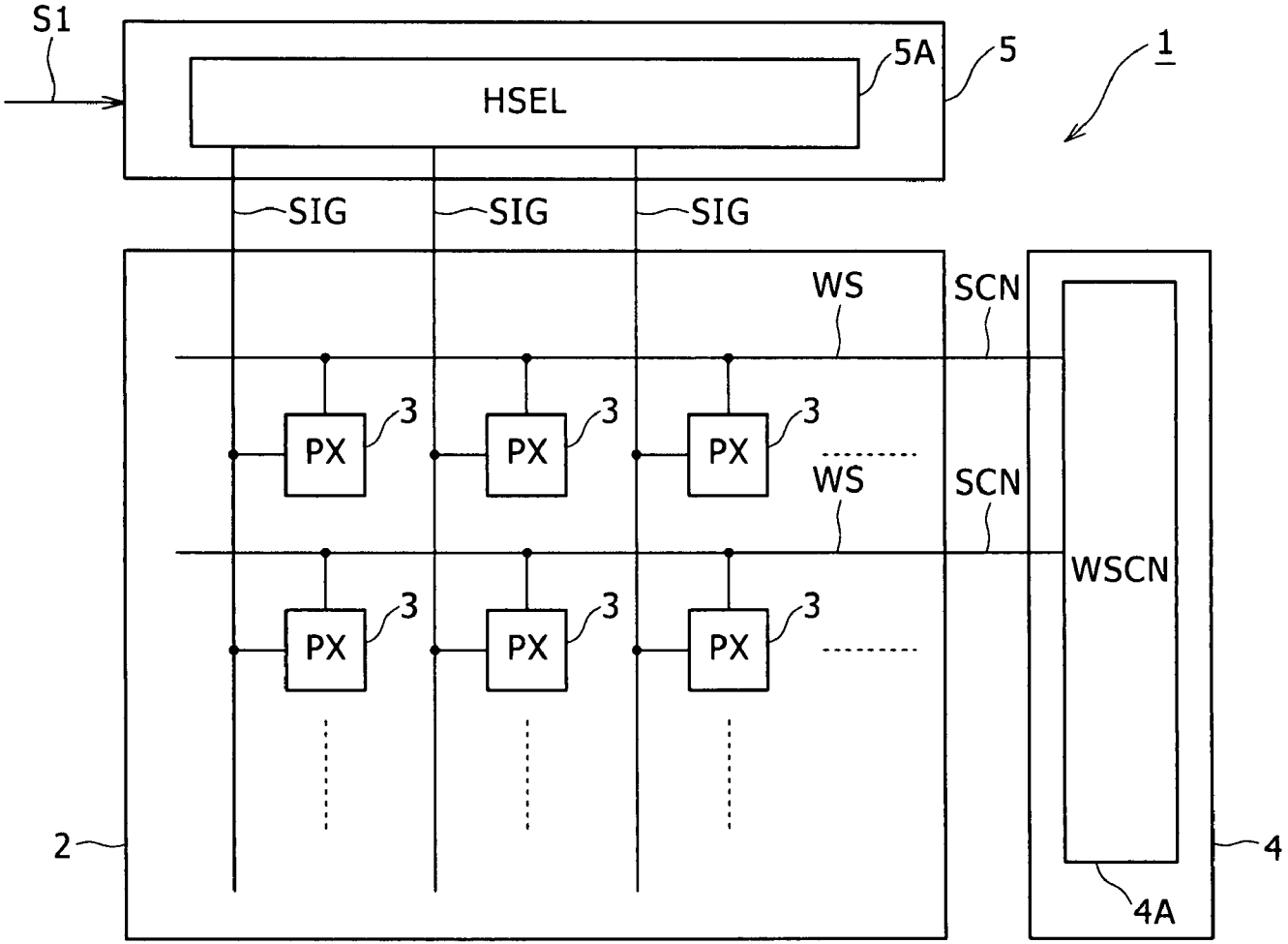
FIG. 4 is a block diagram showing an existing display apparatus.
Figure 5:
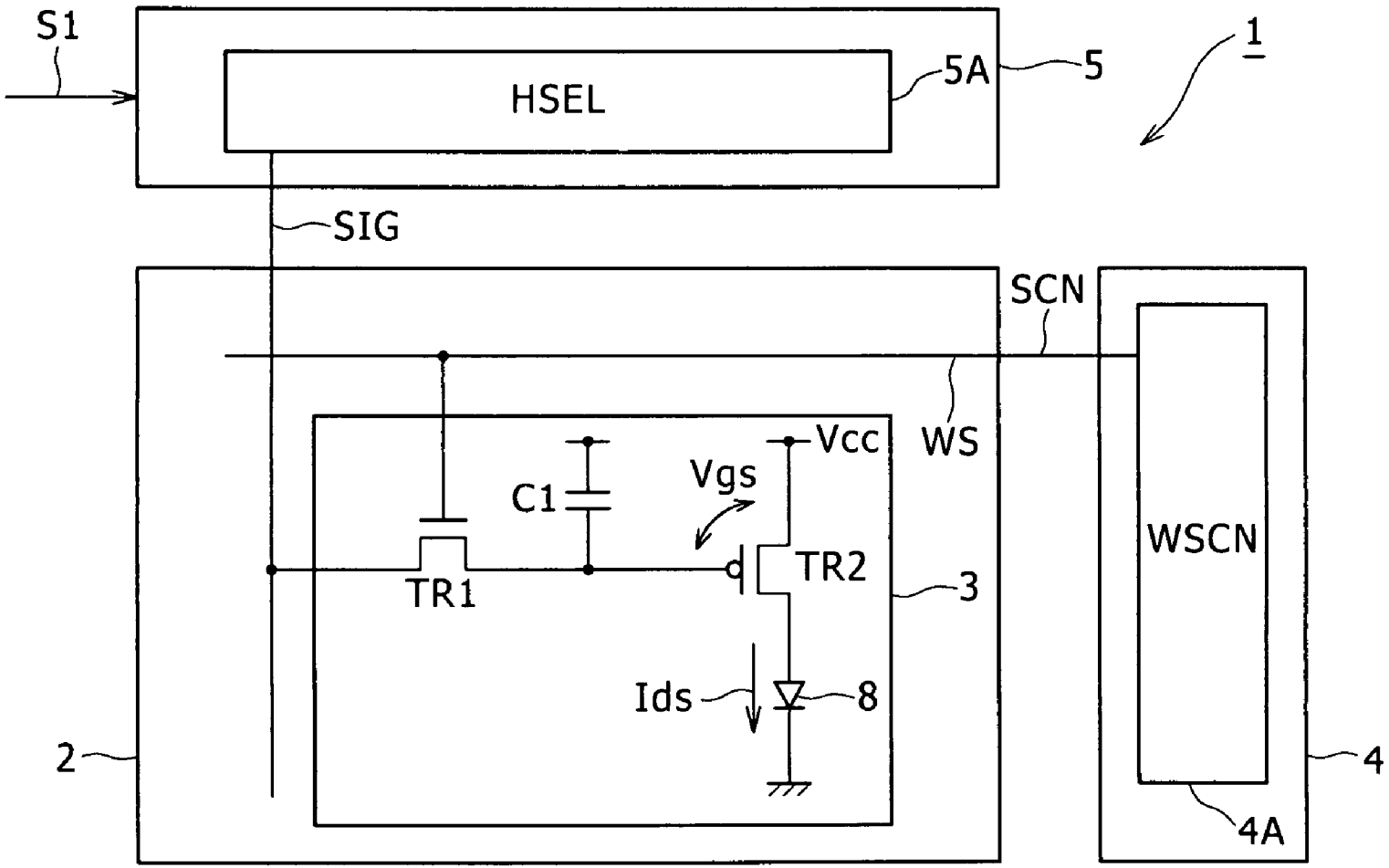
FIG. 5 is a block diagram showing a detailed configuration of the display apparatus of FIG. 4.
Figure 6:
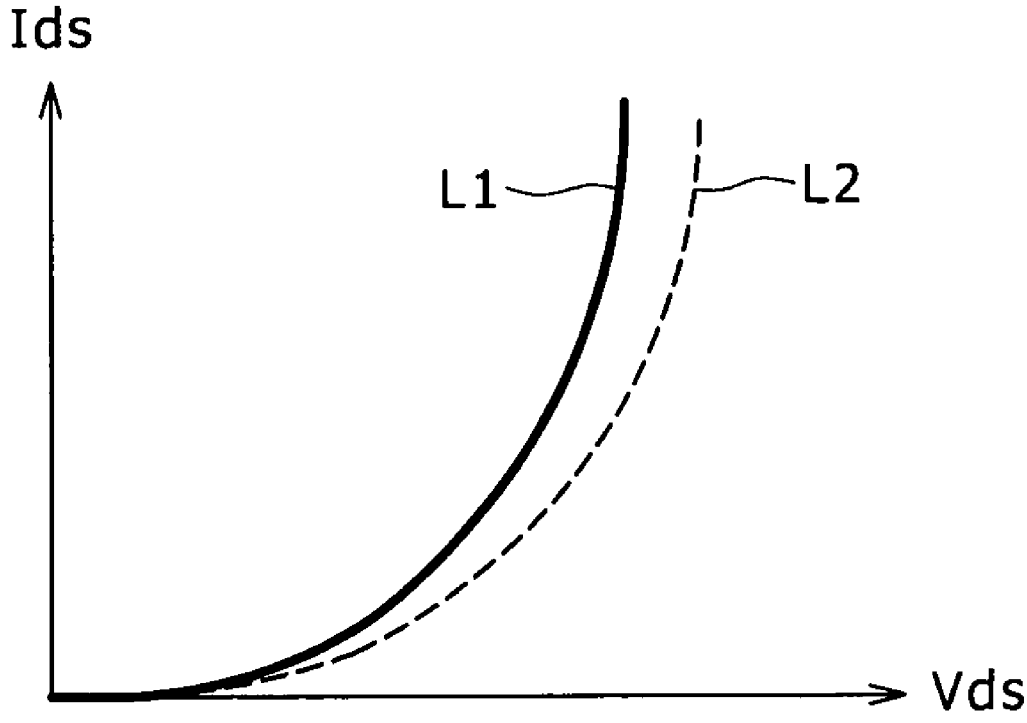
FIG. 6 is a characteristic diagram illustrating a secular change of an organic EL device.
Figure 7:
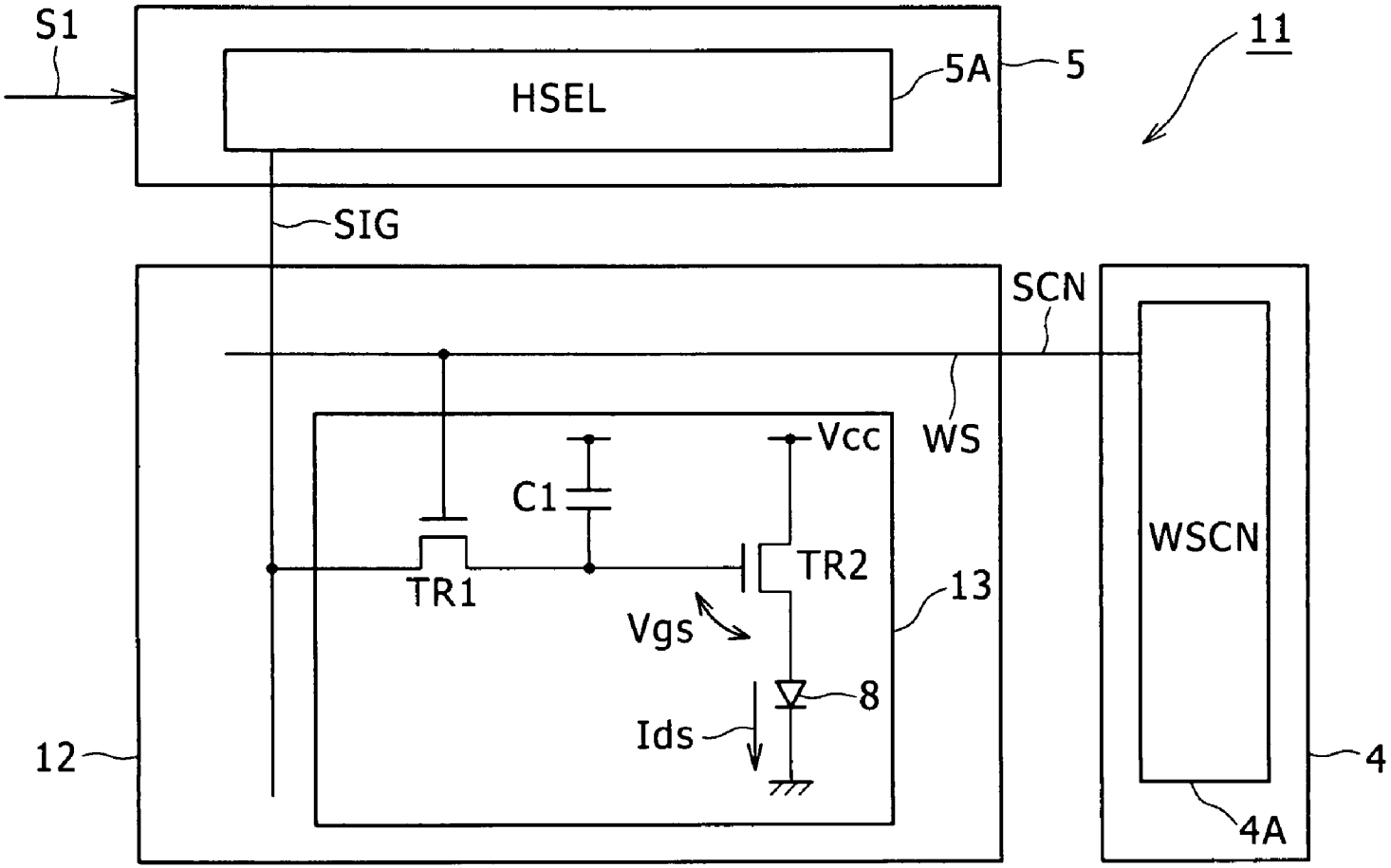
FIG. 7 is a block diagram showing the display apparatus shown in FIG. 5 where an N-channel transistor is used.
Figure 8:
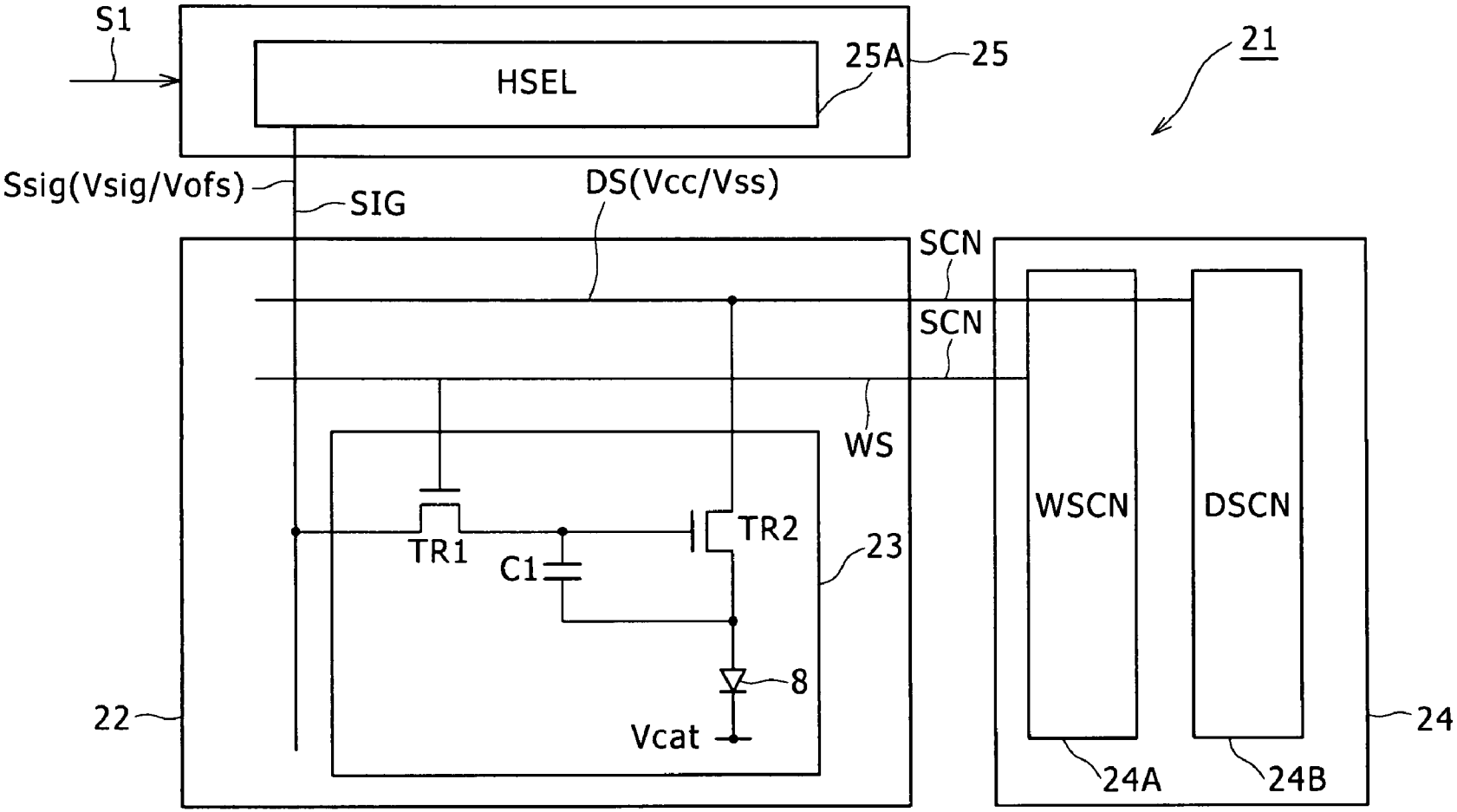
FIG. 8 is a block diagram showing a possible display apparatus wherein an N-channel transistor is used.

FIG. 2 shows part of a display apparatus according to a second embodiment of the present invention for comparison with FIG. 24. Referring to FIG. 2, the display apparatus 41 shown is configured such that signal lines SIGR, SIGG and SIGB provided in a display section 42 are driven by horizontal driving circuits 45A and 45B to produce a fixed voltage Vofs and a halftone voltage Vofs2 by a power supply provided in the horizontal driving circuit 45A. Further, as seen from FIGS. 3A and 3B, switch circuits P1R, P1G and P1B and P2R, P2G and P2B are set to an on state to set the signal lines SIGR, SIGG and SIGB to the fixed voltage Vofs and the halftone voltage Vofs2. Further, in the present embodiment, the signal lines SIGR, SIGG and SIGB are set to the fixed voltage Vofs and the halftone voltage Vofs2 by precharge switches. Further, in the present embodiment, the halftone voltage Vofs2 is set as a fixed potential as an example.

Further, a driving signal Vsig as a time division multiplex signal of the gradation voltages VsigR, VsigG and VsigB of pixels 33R, 33G and 33B for red, green and blue is produced by an analog to digital conversion circuit or the like provided in the horizontal driving circuit 45B, and switch circuits TR, TG and TB are successively placed into an on state as seen from FIGS. 3C to 3H to output the driving signal Vsig to the signal lines SIGR, SIGG and SIGB so that signal lines SIGR, SIGG and SIGB are set to the gradation voltages VsigR, VsigG and VsigB, respectively. The display apparatus of the present embodiment is configured similarly to that of the first embodiment except the setting method of the fixed voltage Vofs, halftone voltage Vofs2 and gradation voltages VsigR, VsigG and VsigB.

Even where the signal lines SIGR, SIGG and SIGB are set to the fixed voltage Vofs and the halftone voltage Vofs2 by the precharge switch as in the present embodiment, similar effects to those of the first embodiment can be achieved.

Third Embodiment

It is to be noted that, while, in the embodiments described above, one pixel of a color image is formed from pixels for red, green and blue and signal lines for such pixels for red, green and blue are driven time-divisionally, the present invention is not limited to the embodiments but can be applied widely also where a plurality of signal lines for pixels are driven time-divisionally. Further, the present invention can be applied widely also where only one signal line is driven by a single driving circuit.

Further, while, in the embodiments described above, an organic EL device is used as a light emitting device, the present invention can be applied widely also where various light emitting devices of the current-driven type are used.

The present invention can be applied to a display apparatus of the active matrix type by an organic EL device for which, for example, a polycrystalline silicon TFT is used.

While preferred embodiments of the present invention have been described using specific terms, such description is for illustrative purposes only, and it is to be understood that changes and variations may be made without departing from the spirit or scope of the following claims.

In the drawings:

FIG. 2
- 33R, 33G, 33B: pixel

Figure 14:
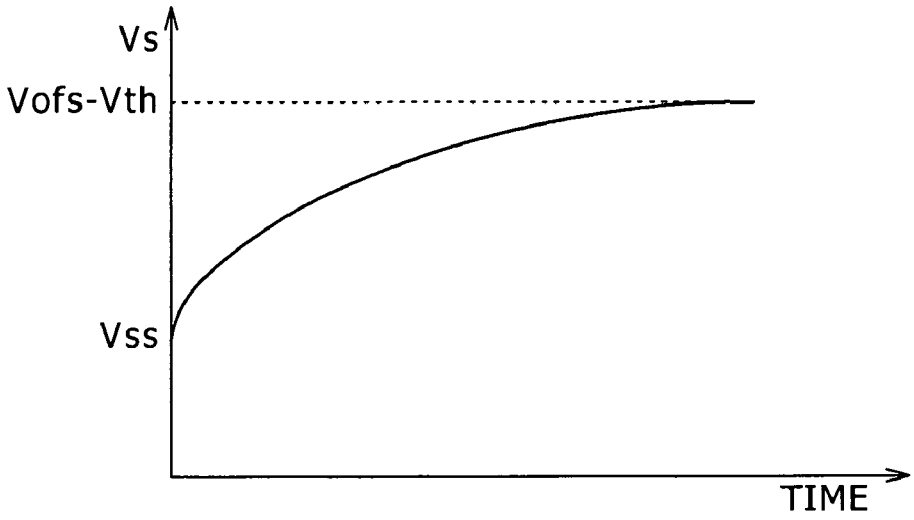
FIG. 14 is a characteristic diagram illustrating correction of a threshold voltage.
Figure 15:
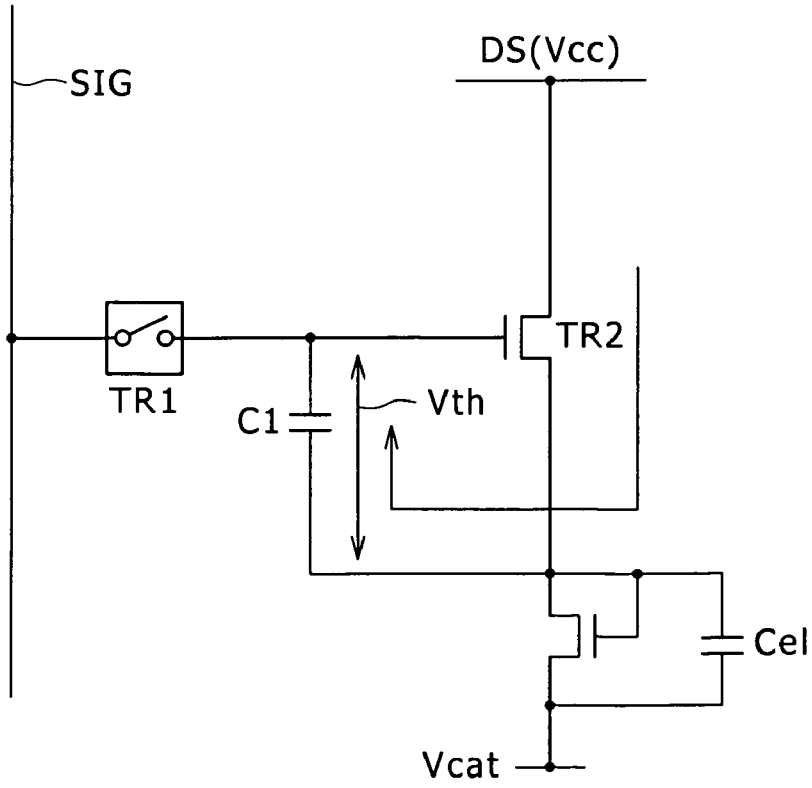
FIGS. 15 and 16 are circuit diagrams illustrating operation of the pixel shown in FIGS. 10 to 13 next to the operation illustrated in FIG. 13.
Figure 16:
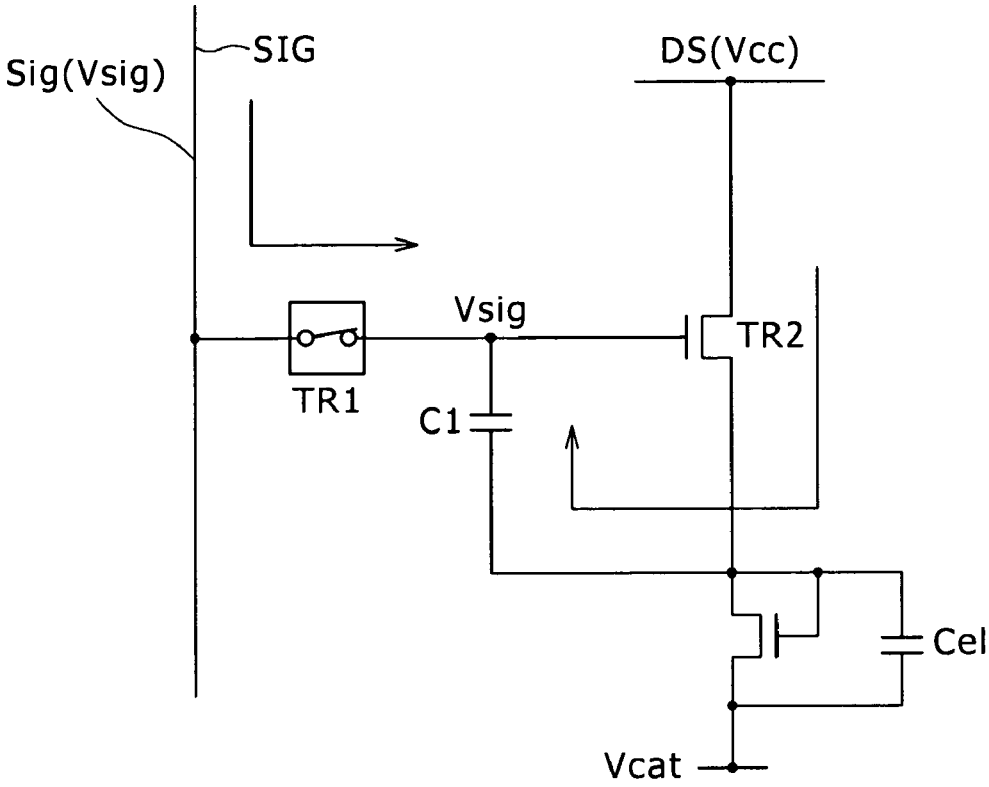
Figure 17:
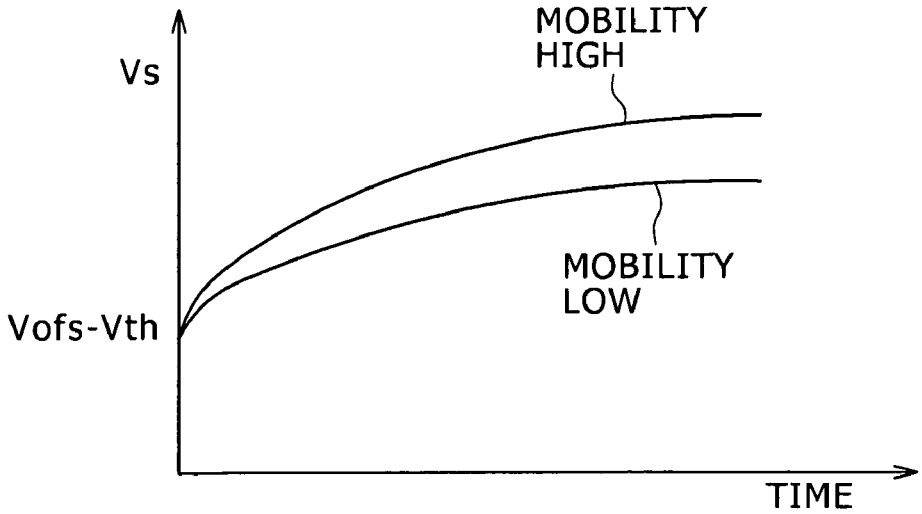
FIG. 17 is a characteristic diagram illustrating correction of the mobility.
Figures 19A, 19B, 19C, 19D, 19E:
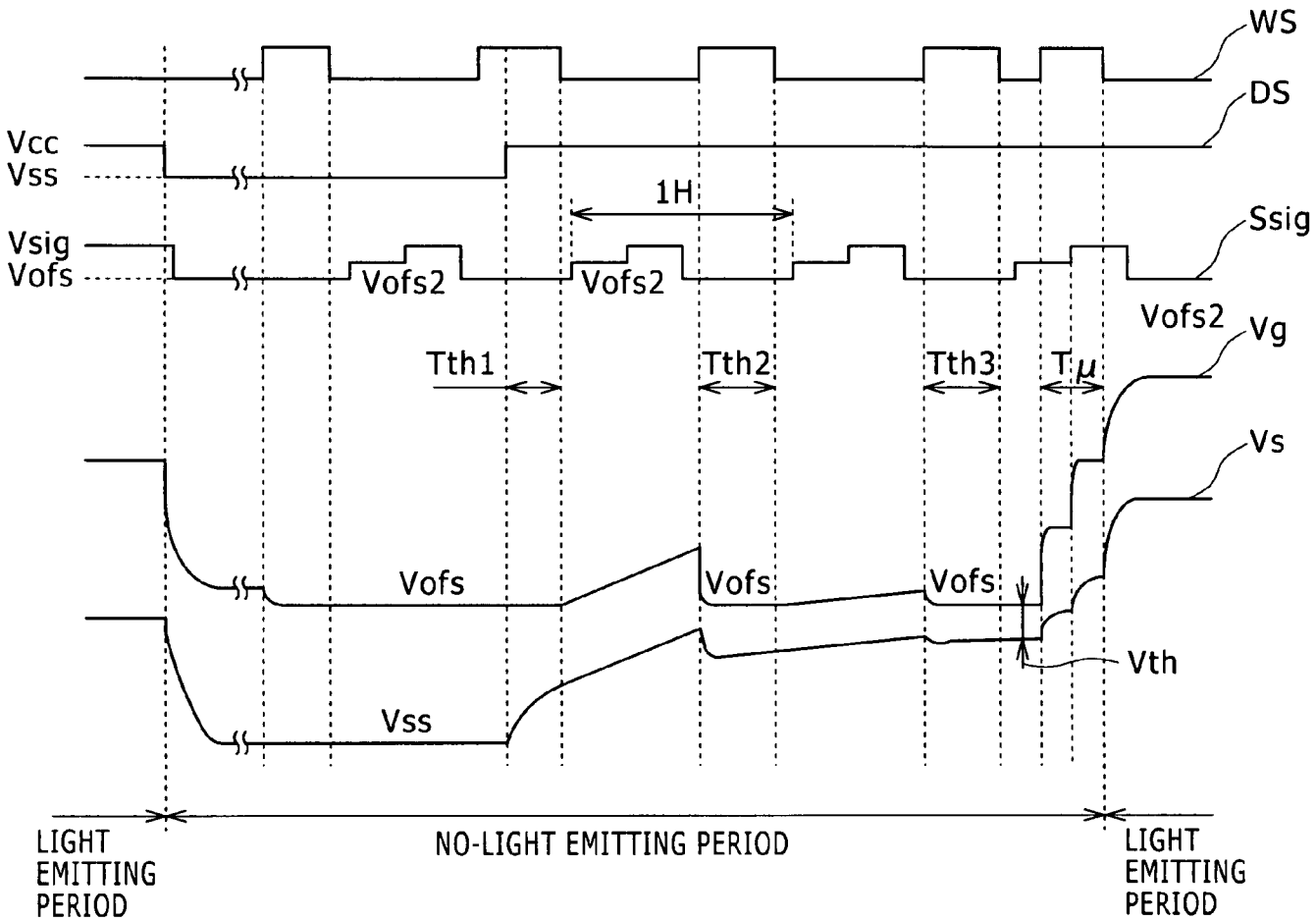
FIGS. 19A to 19E are time charts illustrating correction for the dispersion of the mobility wherein a voltage of a halftone is used.

FIG. 9, from left
- Light emitting period
- No-light emitting period
- Light emitting period FIG. 14
- Time FIG. 17, from above
- Mobility high
- Mobility low
- Time FIG. 18, from above
- Luminance (Vs)
- White gradation
- Gray gradation
- Time required for correction FIG. 19, from left
- Light emitting period
- No-light emitting period
- Light emitting period FIGS. 20 to 23, from above
- Voltage
- Time FIG. 24
- 33R, 33G, 33B: pixel

What is claimed is:

1. A display apparatus, comprising:

a display section including a plurality of pixels disposed in a matrix and a plurality of signal lines and a plurality of scanning lines; and a horizontal driving circuit and a vertical driving circuit configured to drive said signal lines and said scanning lines of said display section to display an image on said display section;

each of said pixels including a light emitting device, a signal level storage capacitor, a writing transistor having a gate to which a wiring signal outputted from said vertical driving circuit is inputted to turn on said writing transistor to set a terminal voltage of said signal level storage capacitor to a signal level of a corresponding one of said signal lines, and a driving transistor having a gate and a source connected to the opposite terminals of said signal level storage capacitor to drive said light emitting device in response to the voltage across said signal level storage capacitor thereby to cause said light emitting device to emit light;

said horizontal driving circuit and said vertical driving circuit being operable, within a first period of a no-light emitting period of each of said pixels within which the emission of light of said light emitting device is stopped, to turn on said writing transistor of the pixel to set a voltage at a first one of the terminals of said signal level storage capacitor to a halftone voltage corresponding to a halftone of said light emitting device through the signal line and turn on said driving transistor to charge a second one of the terminals of said signal level storage capacitor from said driving transistor, and within a second period of the no-light emitting period following the first period, to set the potential at the first terminal of said signal level storage capacitor to a fixed voltage, with which said driving transistor is turned off, through the signal line to hold the potential at the second terminal of said signal level storage capacitor to the potential set within the first period, and then within a third period of the no-light emitting period following the second period, to set the potential at the first terminal of said signal level storage capacitor to a gradation voltage corresponding to a gradation with which the light emitting device emits light and turn on said driving transistor to charge the second terminal of said signal level storage capacitor from said driving transistor and then turn off said writing transistor.

2. The display apparatus according to claim 1, wherein said horizontal driving circuit and said vertical driving circuit drive said signal lines time-divisionally.

3. The display apparatus according to claim 2, wherein the time-divisional driving of said signal lines is a process of setting the halftone voltage or the fixed voltage simultaneously to the signal level storage capacitors of the pixels of a gradation setting object connected to said signal lines, and setting said signal lines successively to the gradation voltages of the pixels of the gradating setting object to hold the gradation voltage by capacitance of said signal lines and then setting the gradation voltage held in said signal lines to the signal level storage capacitors of the pixels of the gradation setting object.

4. The display apparatus according to claim 1, wherein said horizontal driving circuit connects said signal lines to the fixed voltage or the halftone voltage through respective switch circuits to set the fixed voltage or the halftone voltage to the signal level storage capacitors of the pixels.

5. A driving method for a display apparatus which includes a display section including a plurality of pixels disposed in a matrix and a plurality of signal lines and a plurality of scanning lines, and a horizontal driving circuit and a vertical driving circuit configured to drive the signal lines and the scanning lines of the display section to display an image on the display section, each of the pixels including a light emitting device, a signal level storage capacitor, a writing transistor having a gate to which a wiring signal outputted from the vertical driving circuit is inputted to turn on the writing transistor to set a terminal voltage of the signal level storage capacitor to a signal level of a corresponding one of the signal lines, and a driving transistor having a gate and a source connected to the opposite terminals of the signal level storage capacitor to drive the light emitting device in response to the voltage across the signal level storage capacitor thereby to cause the light emitting device to emit light, said driving method comprising the steps of:

turning on, within a first period of a no-light emitting period of each of the pixels within which the emission of light of the light emitting device is stopped, the writing transistor of the pixel to set a voltage at a first one of the terminals of the signal level storage capacitor to a halftone voltage corresponding to a halftone of the light emitting device through the signal line and turn on the driving transistor to charge a second one of the terminals of the signal level storage capacitor from the driving transistor;

setting, within a second period of the no-light emitting period following the first period, the potential at the first terminal of the signal level storage capacitor to a fixed voltage, with which the driving transistor is turned off, through the signal line to hold the potential at the second terminal of the signal level storage capacitor to the potential set within the first period; and setting, within a third period of the no-light emitting period following the second period, the potential at the first terminal of the signal level storage capacitor to a gradation voltage corresponding to a gradation with which the light emitting device emits light and turn on the driving transistor to charge the second terminal of the signal level storage capacitor from the driving transistor and then turn off the writing transistor.

* * * * *